US012768172B2

(12) United States Patent
Edwards et al.

(10) Patent No.: US 12,768,172 B2
(45) Date of Patent: Oct. 20, 2026

(54) ADJUSTABLE GRAB RAILING

(71) Applicant: Carolina Stair Supply, Inc., Uhrichsville, OH (US)

(72) Inventors: Matthew S. Edwards, Bolivar, OH (US); Sheldon Scott Kittle, Canal Fulton, OH (US)

(73) Assignee: Carolina Stair Supply, Inc., Uhrichsville, OH (US)

( * ) Notice: Subject to any disclaimer, the term of this patent is extended or adjusted under 35 U.S.C. 154(b) by 187 days.

(21) Appl. No.: 18/738,795

(22) Filed: Jun. 10, 2024

(65) Prior Publication Data

US 2024/0410180 A1 Dec. 12, 2024

Related U.S. Application Data

(60) Provisional application No. 63/616,355, filed on Dec. 29, 2023, provisional application No. 63/518,358, filed on Aug. 9, 2023, provisional application No. 63/506,857, filed on Jun. 8, 2023.

(51) Int. Cl.
*E04F 11/18* (2006.01)
*A47K 17/02* (2006.01)

(52) U.S. Cl.
CPC ..... *E04F 11/1804* (2013.01); *E04F 11/1808* (2013.01); *A47K 17/024* (2013.01); *E04F 2011/187* (2013.01)

(58) Field of Classification Search
CPC ..... A47K 17/022; A47K 17/024; E04F 11/18; E04F 11/1802; E04F 11/1804; E04F 11/1808; E04F 11/1812; E04F 11/1836; E04F 11/1865; E04F 2011/1868; E04F 2011/187; E04H 17/1448; F16B 7/10–16;
(Continued)

(56) References Cited

U.S. PATENT DOCUMENTS 2,991,485 A * 7/1961 Schulte ..... A61G 7/1067 5/83.1
5,024,420 A * 6/1991 Downing ..... E04B 1/34336 52/150
5,116,025 A 5/1992 Kiniry
(Continued)

FOREIGN PATENT DOCUMENTS

GB 1441825 A * 7/1976 ..... A47K 17/024
JP 2567910 B2 * 12/1996 ..... A47K 17/022
(Continued)

*Primary Examiner* — Josh Skroupa
(74) *Attorney, Agent, or Firm* — Fred Zollinger

(57) ABSTRACT

An adjustable grab railing is mounted to a vertical structure next to the steps. The mounting surface can be flat or a corner. The grab railing includes mounting brackets, an upper rail, a lower rail connected to the upper rail, and an adjustment rail. The mount ends of the upper rail and adjustment rail are selectively, pivotably mounted to mount tabs. A first locking fastener selectively secures each connection. The outer end of the adjustment rail telescopes with respect to the lower rail. A second locking fastener selectively locks the position of the adjustment rail with respect to the lower rail allowing the upper and lower railings to be locked at different angles with respect to the steps and the vertical mounting structure. The lower rail can pivot to be mounted to a horizontal surface.

20 Claims, 23 Drawing Sheets

(58) Field of Classification Search
CPC ..... Y10T 403/32467–32524; Y10T 403/7077–7091
USPC ..... 4/576.1; 256/65.16, 67; 403/109.1–109.8, 377–379.6
See application file for complete search history.

(56) References Cited

U.S. PATENT DOCUMENTS

| | | | | |
|---|---|---|---|---|
| 10,995,496 | B2 | 5/2021 | Burt et al. | |
| 11,096,531 | B2 * | 8/2021 | Edwards | A47K 17/024 |
| 2008/0216227 | A1 * | 9/2008 | Felmeri | A47K 10/38 242/590 |
| 2014/0150210 | A1 * | 6/2014 | Johnson | A47K 17/022 16/110.1 |
| 2022/0010558 | A1 | 1/2022 | Johnson | |

FOREIGN PATENT DOCUMENTS

| | | | | | |
|---|---|---|---|---|---|
| JP | 2922191 | B1 * | 7/1999 | ..... | A47K 17/024 |
| JP | 2001049824 | A * | 2/2001 | ..... | A47K 17/024 |
| JP | 2002038689 | A * | 2/2002 | ..... | A47K 17/022 |
| JP | 2002095612 | A * | 4/2002 | ..... | A47K 17/024 |
| JP | 2004244823 | A * | 9/2004 | ..... | A47K 17/024 |
| JP | 3739041 | B2 * | 1/2006 | ..... | A47K 17/024 |
| WO | WO-2019102048 | A1 * | 5/2019 | ..... | A47K 17/022 |

* cited by examiner

ADJUSTABLE GRAB RAILING

CROSS REFERENCE TO RELATED APPLICATIONS

This application claims the benefit of U.S. Provisional Patent Application Nos. 63/506,857 filed Jun. 8, 2023, 63/518,358 filed Aug. 9, 2023, and 63/616,355 filed Dec. 29, 2023; the disclosures of each are incorporated herein by reference.

BACKGROUND OF THE DISCLOSURE

Technical Field

The disclosure relates to hand railings or grab railings and, more particularly, to an adjustable grab railing wherein the angle or height between the railing and the floor can be adjusted to allow a single device to be used in different configurations.

Background Information

Most building codes require the top of a hand or grab railing to be 34 to 38 inches above the nose of any given stair tread. A grab railing must be installed at the same pitch as the stairs, or the height of the railing will vary along its length.

SUMMARY OF THE DISCLOSURE

The disclosure provides adjustable grab railing configurations.

The disclosure provides adjustable grab railing configurations that can be configured in a zero-degree horizontal configuration and also angled configurations from 31 degrees to 43 degrees having a range of 12 degrees in 2 degree increments.

The disclosure provides a first configuration of an adjustable grab railing configuration that is mounted to a vertical mounting structure such as a wall, door jamb, or molding next to the steps with which it is to be used. The mounting surface can be flat or a corner. The grab railing includes mounting brackets, an upper rail, a lower rail connected to the upper rail, and an adjustment rail. The mount ends of the upper rail and adjustment rail are selectively, pivotably mounted to mount tabs that extend from the mounting brackets that are secured to the mounting structure. A first locking fastener such as a lock down bolt selectively secures each connection. The outer end of the adjustment rail telescopes with respect to the lower rail. A second locking fastener selectively locks the position of the adjustment rail with respect to the lower rail allowing the upper and lower railings to be locked at different angles with respect to the steps and the vertical mounting structure.

The second locking fastener is either a single fastener, a pair of spaced fasteners, or a plurality of fasteners depending on the number of preset adjustment angles that are provided. The second locking fastener can be carried by the adjustment rail. In some of the exemplary configurations, the second locking fastener is a quick snap pin or two spaced quick snap pins that are biased toward a locked position such that the locking pin of the quick snap pin automatically moves to a locked position when a pin opening defined by lower rail is aligned with the locking pin. The pin openings are defined along the lower surface of the lower rail and when adjustments are provided in small increments, the pin openings would have to overlap to provide the small adjustment. To provide small adjustment increments, two spaced fasteners are used with the pin openings for the adjustment angles alternating between the fasteners. In other exemplary configurations, the second locking fastener is one, two, or a plurality of fasteners that extend between the lower rail and the adjustment rail to fix their positions with respect to each other. The fastener can be a bolt, a screw, a pin, or a rivet. The fastener can be placed into preformed openings, or a self-tapping fastener can be used. In another exemplary configuration, the fastener that holds the position of the lower rail with respect to the adjustment rail is a pipe clamp that wraps around the outermost rail and clamps it to the inner rail. The outermost rail can define elongated slots to allow it to collapse and clamp against the inner rail. In another exemplary configuration, a pipe clamp is carried on the end of the outermost rail and is rotated to tighten and fix the position of the outermost rail with respect to the inner rail.

The disclosure provides a second configuration of the adjustable grab railing. In this configuration, the grab railing includes mounting brackets, an upper rail, a lower rail connected to the upper rail, and an adjustment rail. The mount end of the upper rail is selectively, pivotably mounted to a mount tab that extends from the mounting bracket that is secured to the mounting structure. A first locking fastener such as a lock down bolt selectively secures the connection. The lower rail has a first portion and a second portion connected by a selectively adjustable joint that allows the angle between the first and second portions to be adjusted and locked. The second portion of the lower rail can be parallel to the upper rail or arranged to be vertical. When arranged to be vertical, the mount end of the adjustment rail is secured to a horizontal surface such as a floor. The outer end of the adjustment rail telescopes with respect to the second portion of the lower rail. A second locking fastener selectively locks the position of the adjustment rail with respect to the second portion of the lower rail allowing the upper and lower railings to be locked at different angles and heights.

The disclosure provides a third configuration of an adjustable grab railing configuration that is mounted to a vertical mounting structure such as a wall, door jamb, or molding next to the steps or other item with which it is to be used. The mounting surface can be flat or a corner. The grab railing includes mounting brackets, an upper rail, a lower rail connected to the upper rail, and an adjustment rail. The mount ends of the upper rail and adjustment rail are selectively, pivotably mounted to mount tabs that extend from the mounting brackets that are secured to the mounting structure. In this configuration, primary and secondary fasteners are used with the mount tabs to lock the relative positions at one of a plurality of predetermined angles. One or more additional optional locking devices can be used between the lower rail and adjustment rail as described in the first configuration.

In each of these configurations, the rails can have a circular, oval, square, or polygonal cross section. In all the configurations, a cover such as a wood or polymer cover can be carried by the upper rail. In all the configurations, the adjustment rail can telescope inside the lower rail or can telescope outside the lower rail.

In all these configurations, the tabs that mount the upper rail and the adjustment rail are either integral with the mounting bracket or they are joined together with fasteners. In all the embodiments, the fasteners can be accessible from the front of the mounting bracket and visible. Alternatively, in all the embodiments, the fasteners are hidden within the footprint of the tab and are accessed from the rear of the mounting bracket when it is removed from its mounting structure.

In all these configurations, the connection between the tab and railing may include interlocking features that increase the strength of the connection. In another option, the surfaces that engage each other are rough to increase friction between the two elements.

The individual features described below may be combined in different combinations than specifically described below to form different configurations of the device of the disclosure. The locations and the numbers of the items can be changed. The preceding non-limiting aspects of the disclosure, as well as others, are more particularly described below. A more complete understanding of the devices, assemblies, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
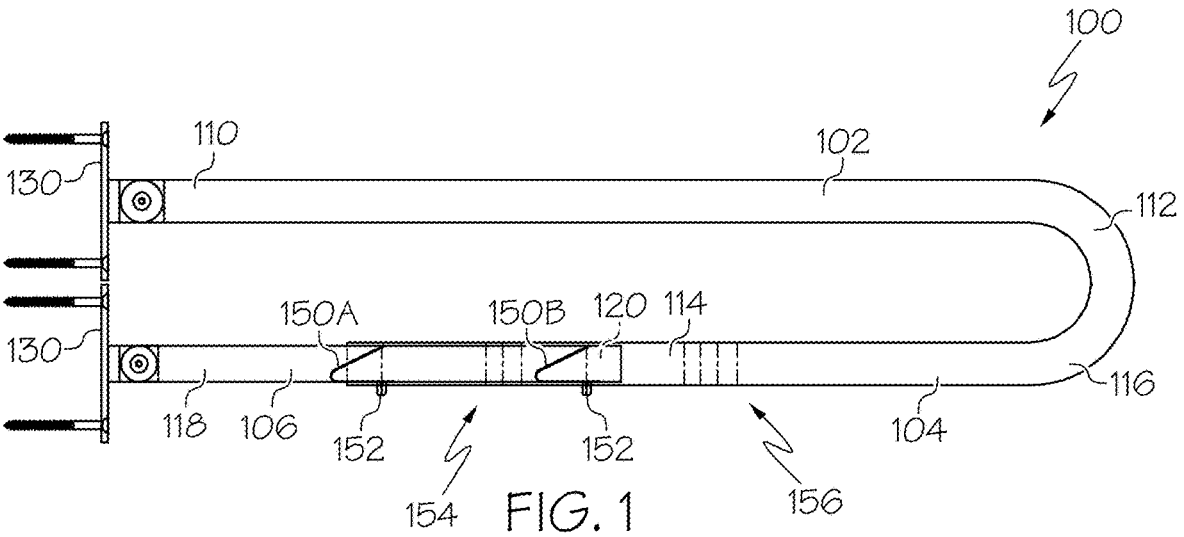
FIG. 1 is a side elevation view of a first configuration of the adjustable grab railing used with a first configuration of the mounting brackets.
Figure 2:
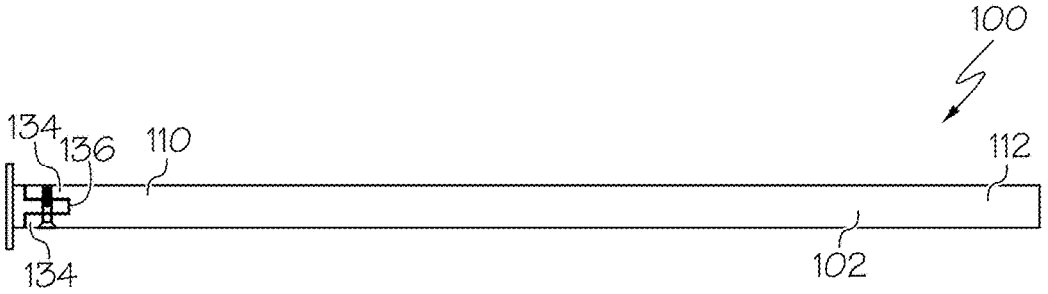
FIG. 2 is a top view of FIG. 1.
Figure 3:
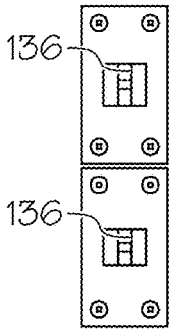
FIG. 3 is a front elevation view of the first configuration of the mounting brackets.
Figure 4:
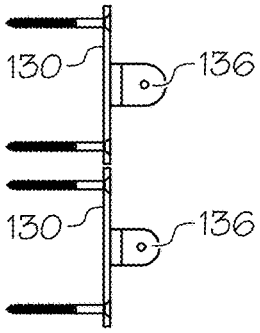
FIG. 4 is a side view of FIG. 3.
Figure 5:
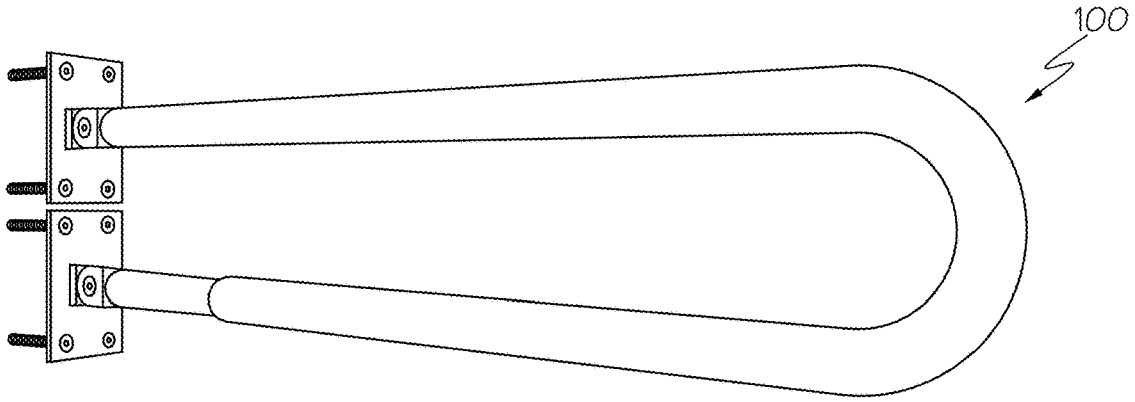
FIG. 5 is a perspective view of the first configuration of the adjustable grab railing using round rails.
Figure 6:
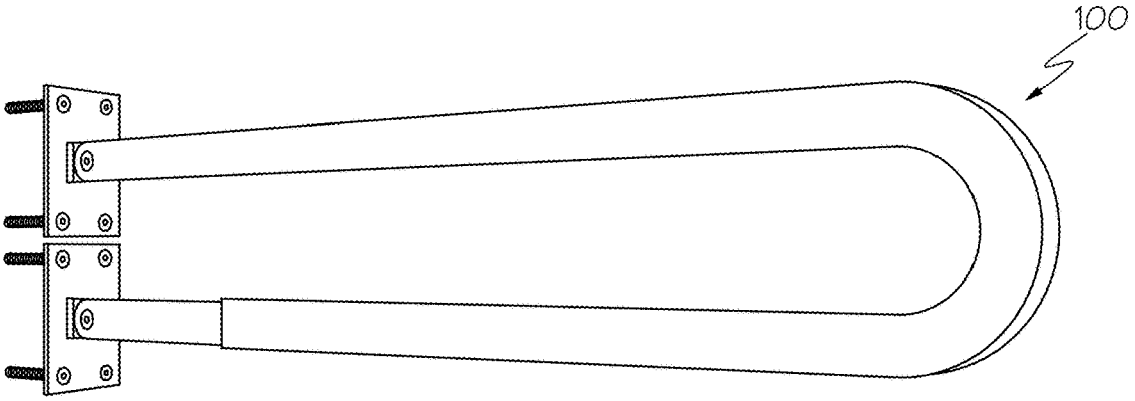
FIG. 6 is a perspective view of the first configuration of the adjustable grab railing using square rails.
Figure 7:
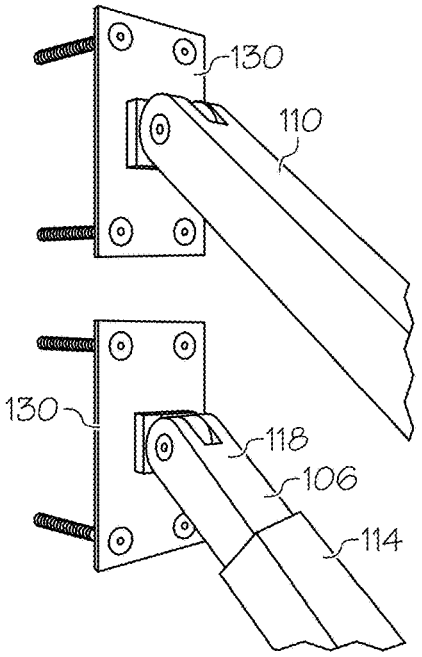
FIG. 7 is a perspective view of the connection between the upper and adjustment rails with the mounting brackets.
Figure 8:
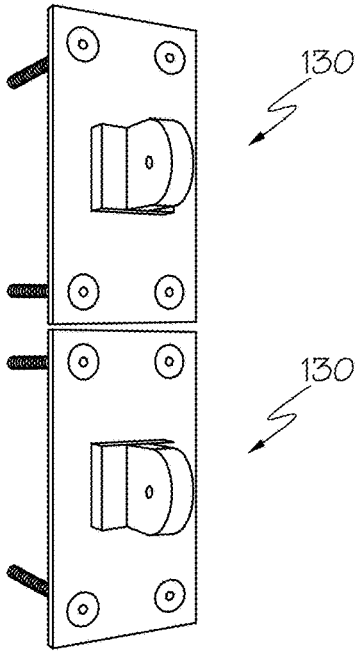
FIG. 8 is a perspective view of the mounting brackets.
Figure 9:
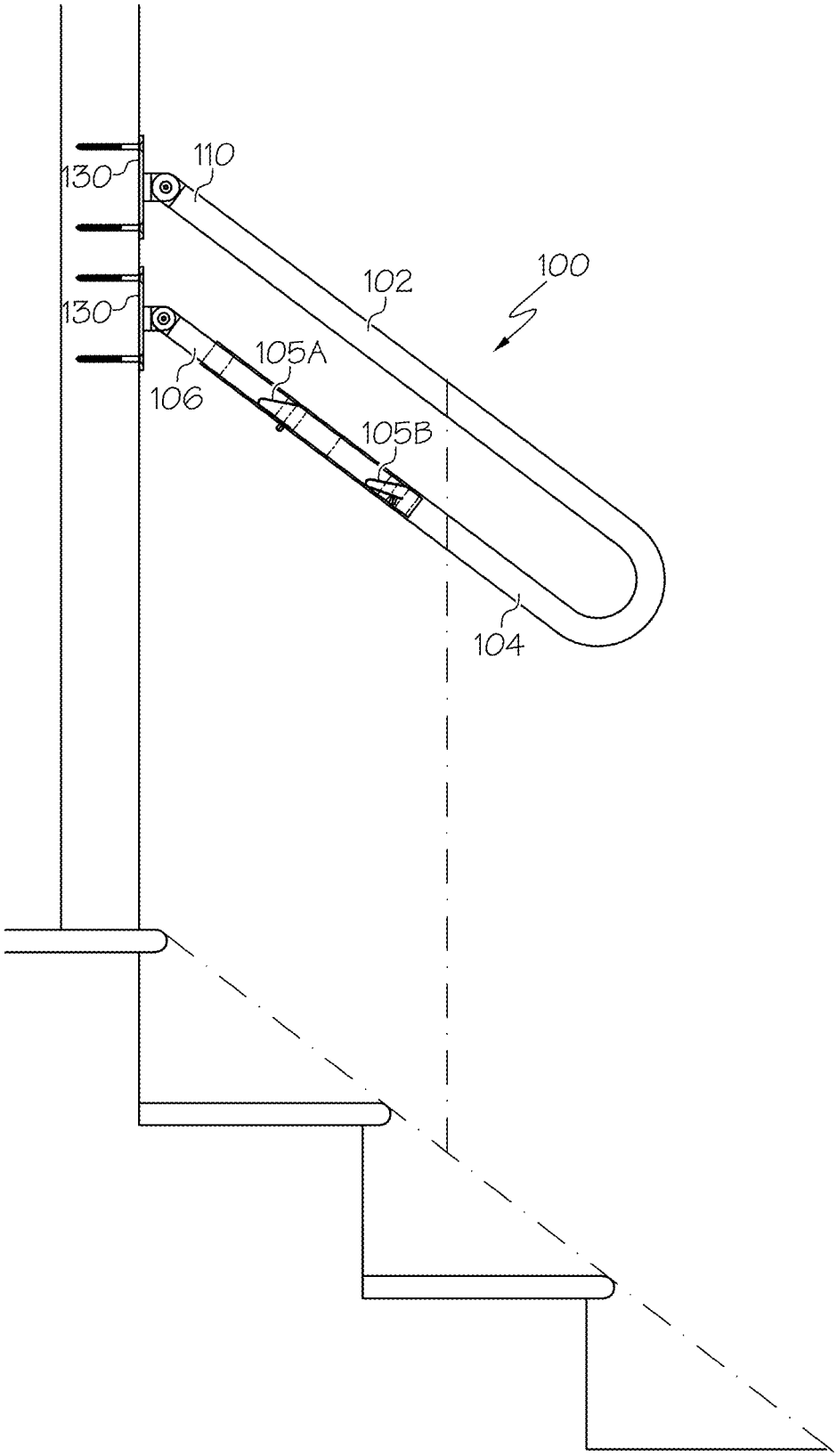
FIG. 9 is a side view of the first configuration of the adjustable grab railing mounted next to steps with the first configuration of the mounting brackets.
Figure 10:
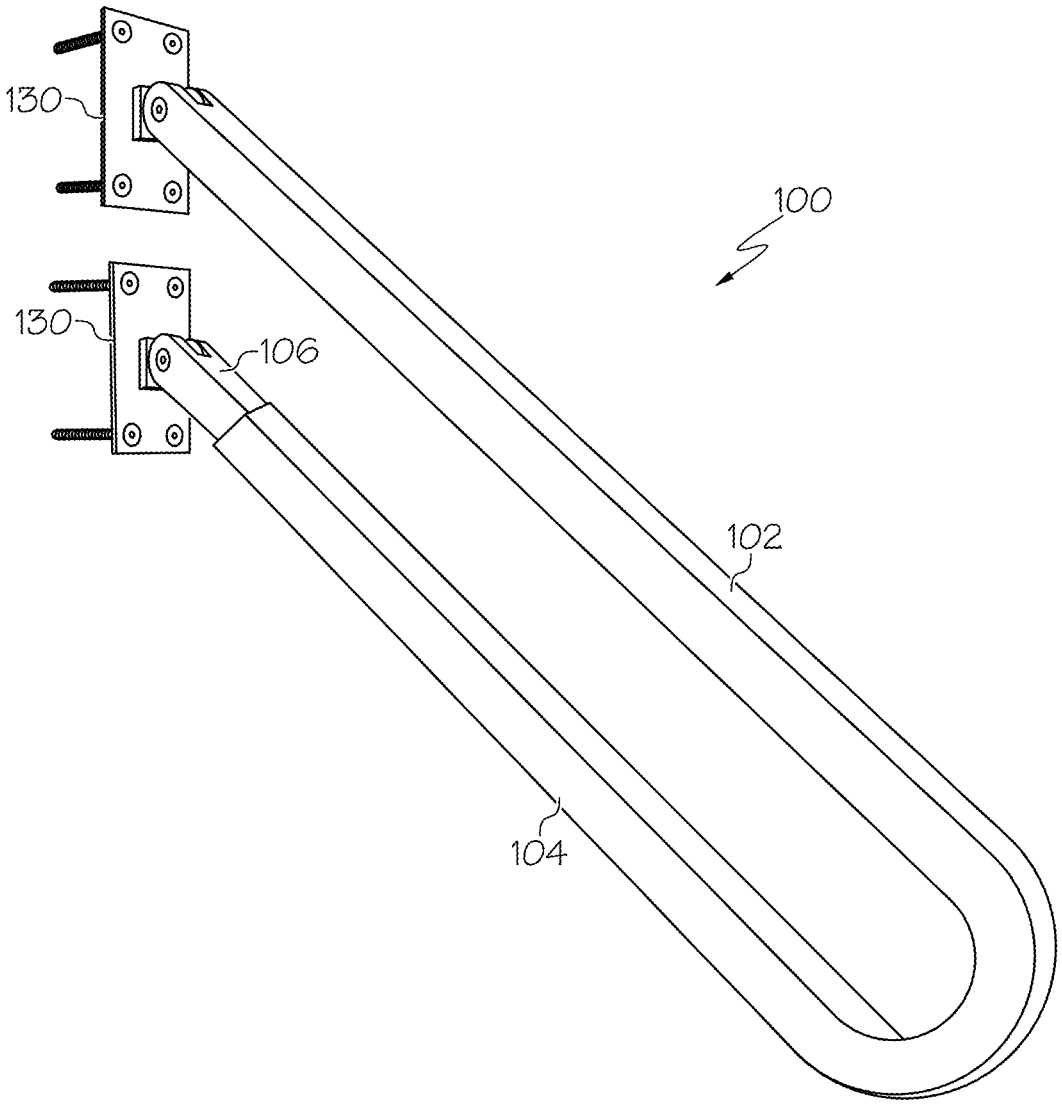
FIG. 10 is a perspective view of the first configuration of the adjustable grab railing adjusted to an angle for use with steps having the same pitch.
Figure 11:
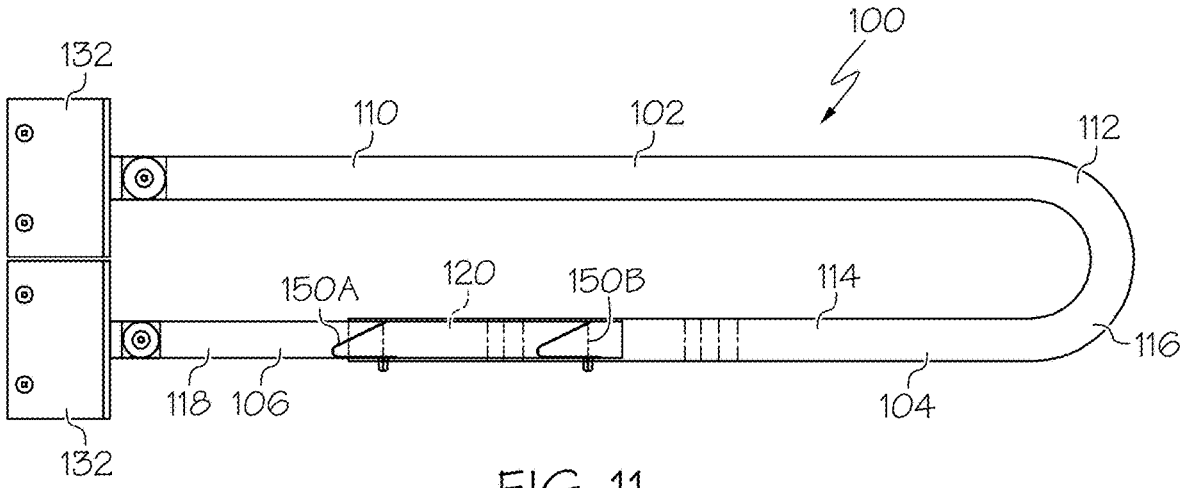
FIG. 11 is a side elevation view of a first configuration of the adjustable grab railing used with a second configuration of the mounting brackets.
Figure 12:
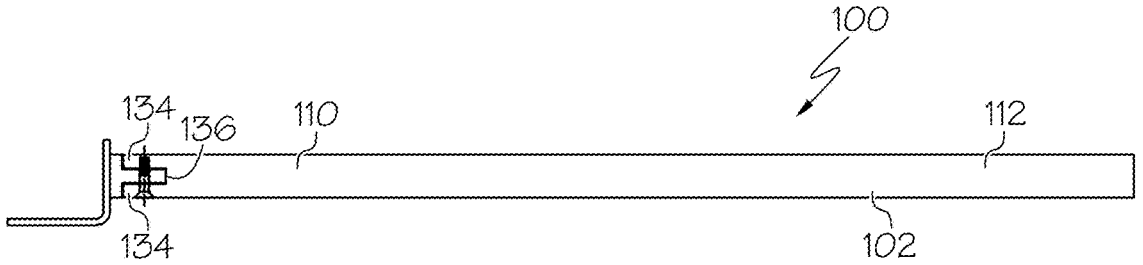
FIG. 12 is a top view of FIG. 11.

This description of exemplary embodiments is intended to be read in connection with the accompanying drawings, which are to be considered part of the entire written description. The drawing figures are not necessarily to scale and certain features may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "joined," "connected," and "interconnected," refer to a relationship wherein structures are secured or attached to one another either directly or indirectly through intervening structures, as well as both movable or rigid attachments or relationships, unless expressly described otherwise.

A first configuration of an adjustable grab railing is indicated generally by the number 100 in FIGS. 1-18 and 31-38. A second configuration of the adjustable grab railing is indicated generally by the number 200 in FIGS. 19-30. The different configurations share elements and the same reference numbers are sometimes used in the drawings to identify common elements.

Adjustable grab railing 100 includes an upper rail 102, a lower rail 104, and an adjustment rail 106. Upper rail 102 has a mount end 110 and an outer end 112. Lower rail 104 has an adjustment end 114 and an outer end 116. Adjustment rail 106 has a mount end 118 and an adjustment end 120. Outer end 112 of upper rail 102 is connected to outer end 116 of lower rail 104. In the example depicted in the drawings, upper rail 102 and lower rail 104 are integrally connected at a 180-degree curved bend. In other configurations, an outer rail is used to connect the two outer ends 112 and 116. Outer rail provides either a squared off configuration or a rounded configuration. Outer rail is connected to the others with welds or fasteners. Rails 102, 104, and 106 have a round, oval, square, or polygonal cross section and are metal tubes. For example, 1.25-inch round or square tubes are used for rails 102 and 104. In alternative embodiments, a cover 140 (FIG. 18) is carried on rail 102. Cover 140 is wood, metal, or polymer to provide a different grip shape and feel to railing 100.

In the examples depicted in the drawings, adjustment end 120 of adjustment rail 106 telescopes inside adjustment end 114 of lower rail 104. At least adjustment end 120 thus has a cross-section dimension (width or diameter) that is small enough to allow it to slide inside lower rail 104. In other configurations, the telescoping arrangement is reversed with adjustment end 114 of lower rail 104 located inside adjustment end 120 of adjustment rail 106. The arrangement allows the straight main portions of upper rail 102 and lower rail 104 to remain parallel in all adjustment positions. Maintaining both in parallel provides a barrier function to railing 100 in addition to its hand rail function.

Figure 13:
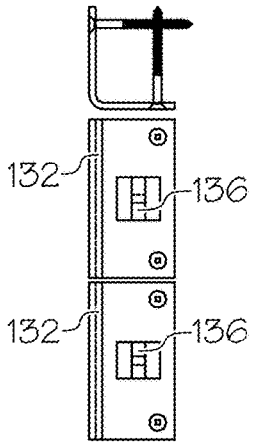
FIG. 13 is a front elevation view and top plan view of the second configuration of the mounting brackets.
Figure 14:
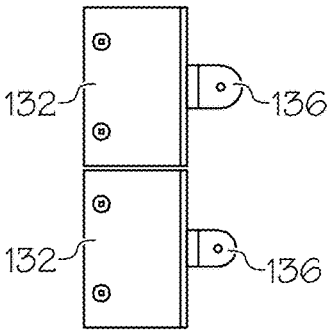
FIG. 14 is a side view of FIG. 13.
Figure 15:
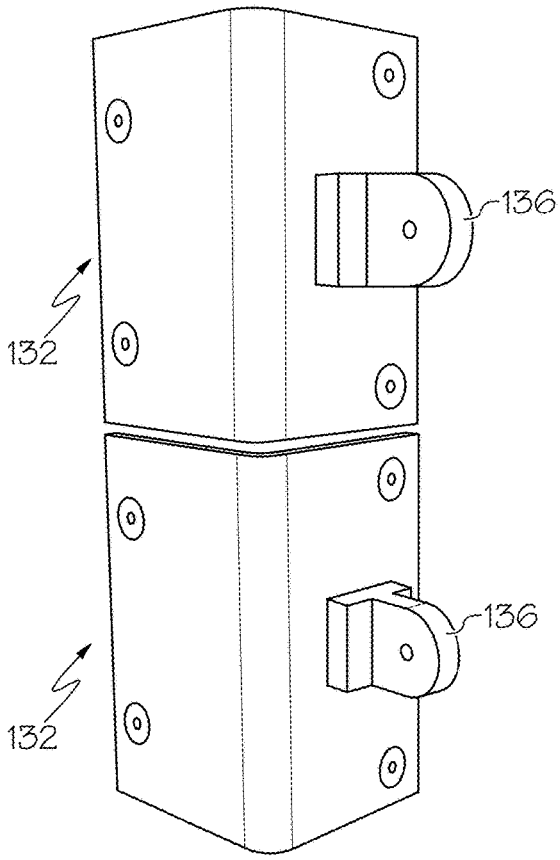
FIG. 15 is a perspective view showing the front and side of the second configuration of the mounting brackets.
Figure 16:
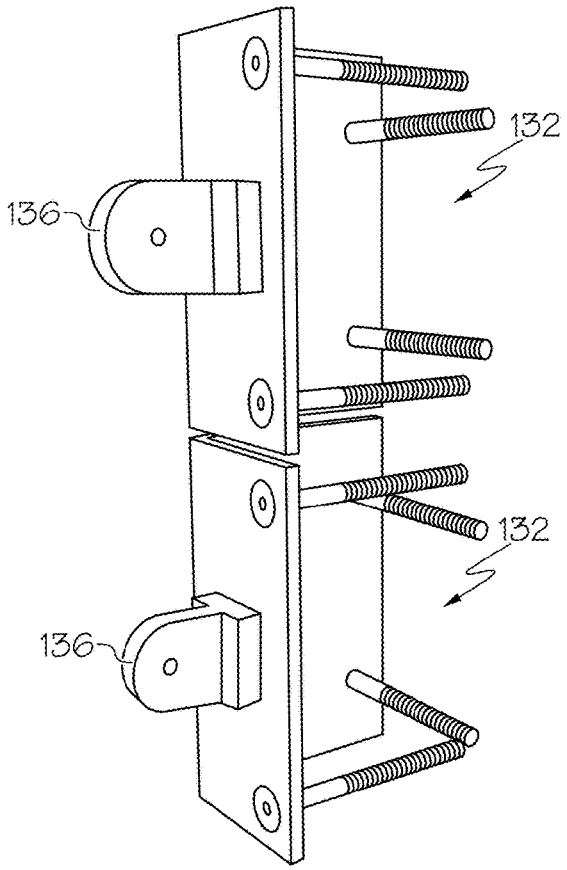
FIG. 16 is a perspective view showing the front and rear of the second configuration of the mounting brackets.
Figure 17:
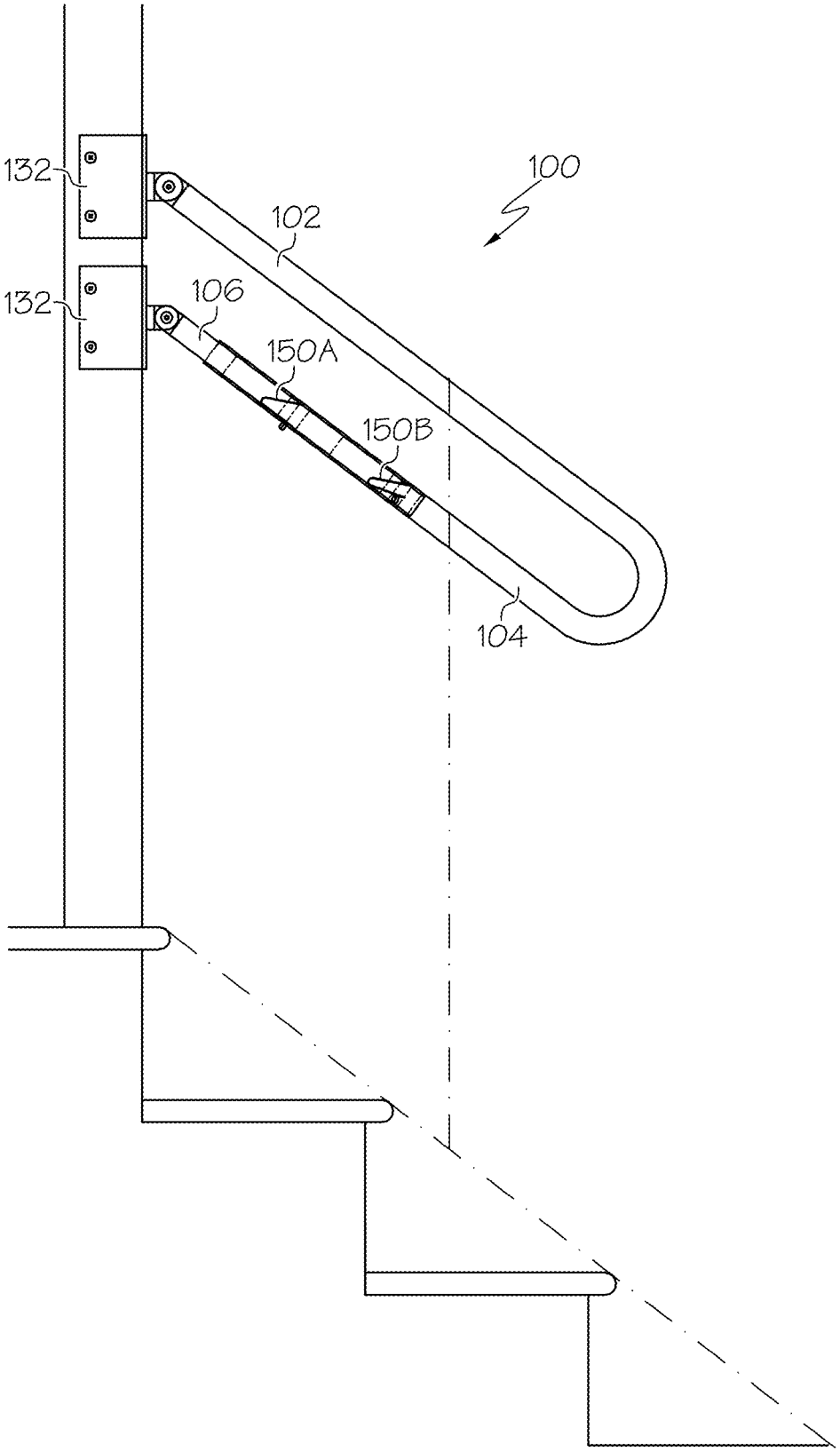
FIG. 17 is a side view of the first configuration of the adjustable grab railing mounted next to steps with the second configuration of the mounting brackets.
Figure 18:
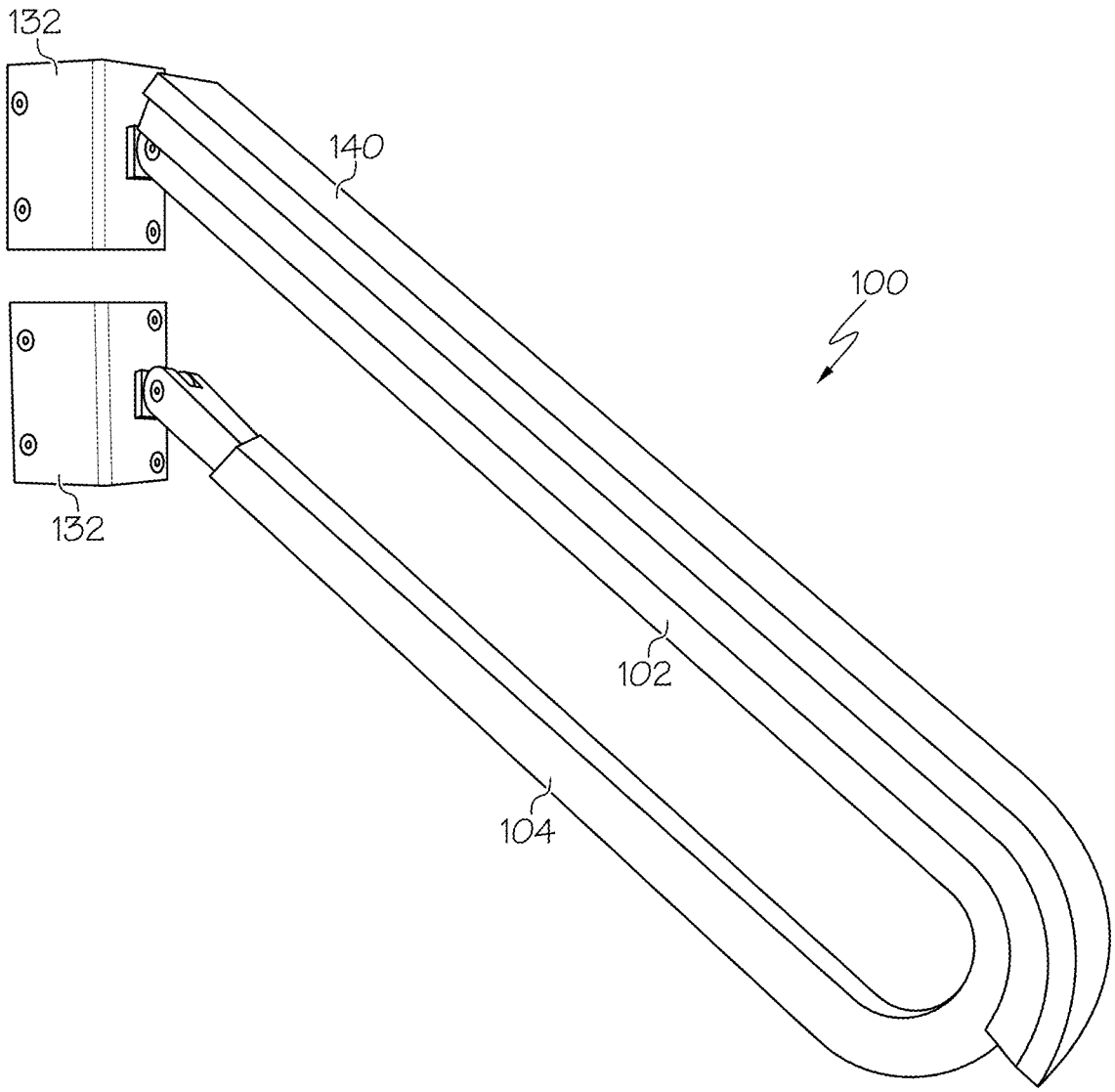
FIG. 18 is a perspective view of the first configuration of the adjustable grab railing adjusted to an angle for use with steps having the same pitch with an alternative cover for the upper rail.
Figure 19:
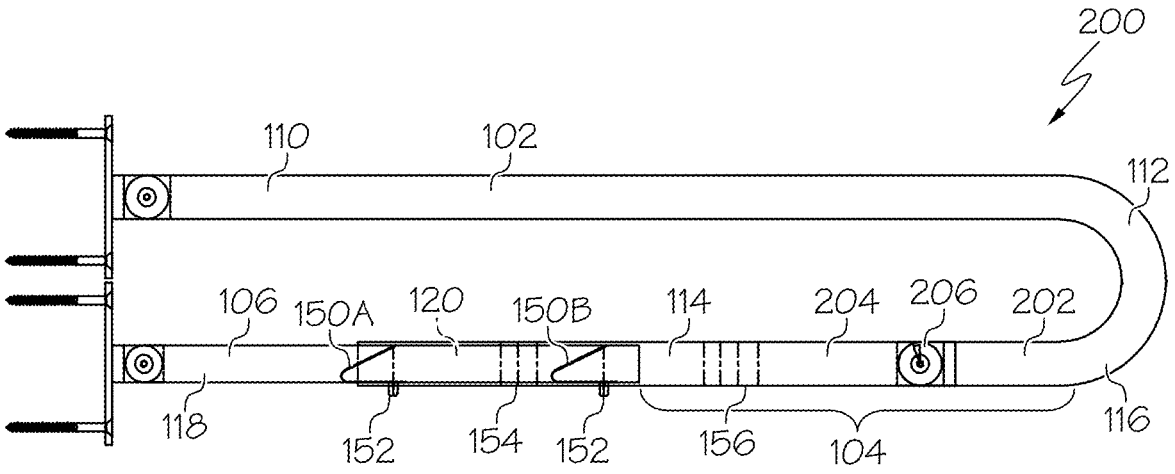
FIG. 19 is a side elevation view of a second configuration of the adjustable grab railing used with a first configuration of the mounting brackets.
Figure 20:
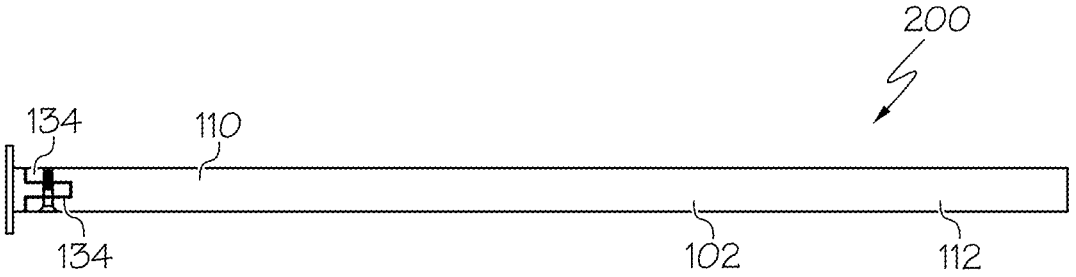
FIG. 20 is a top view of FIG. 19.
Figure 21:
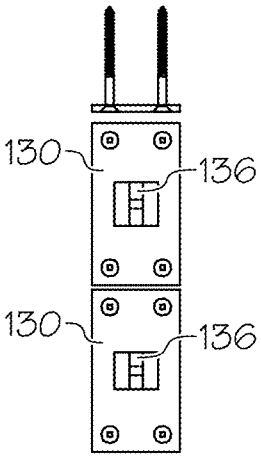
FIG. 21 is a front elevation view and top plan view of the first configuration of the mounting brackets.
Figure 22:
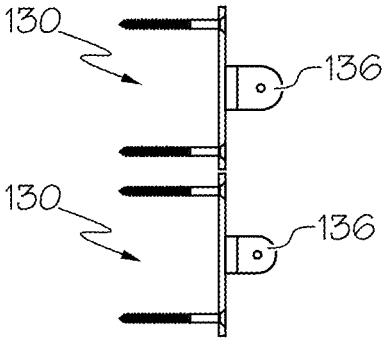
FIG. 22 is a side view of FIG. 21.
Figure 23:
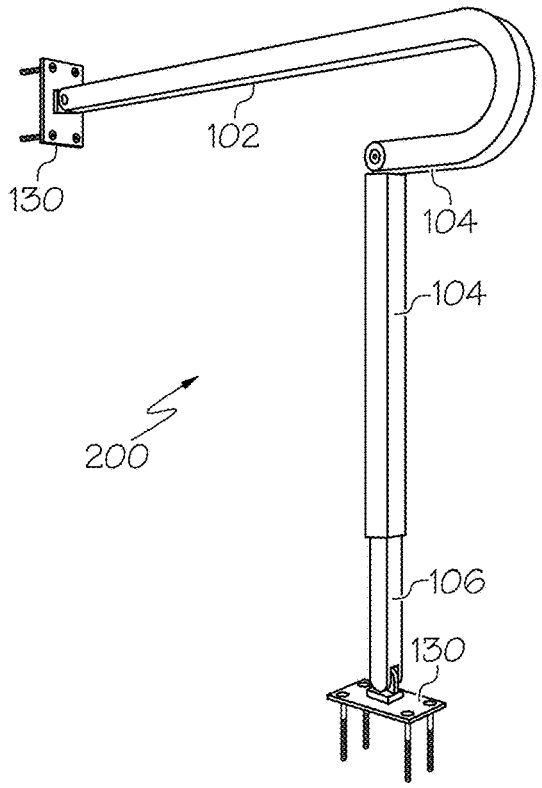
FIG. 23 is a perspective view of the second configuration of the adjustable grab railing with the second portion of the lower rail arranged in a vertical condition.
Figure 24:
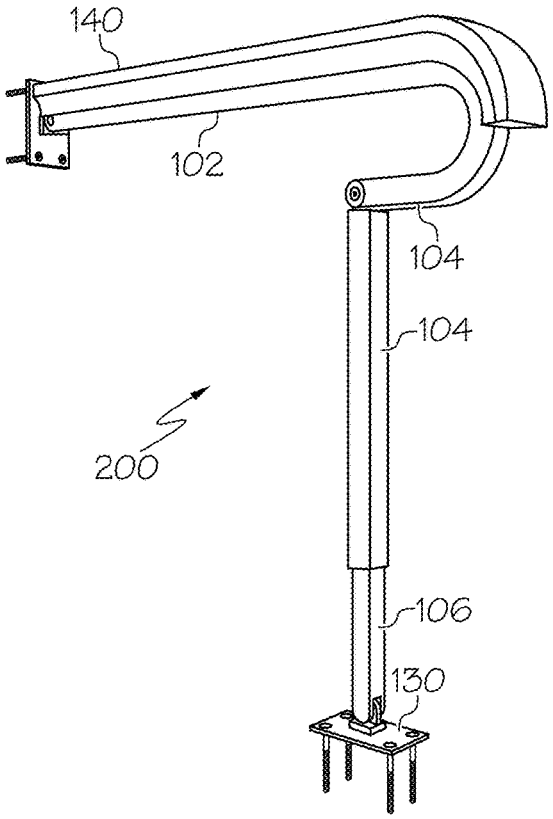
FIG. 24 is a view similar to FIG. 23 with an alternative cover for the upper rail.
Figure 25:
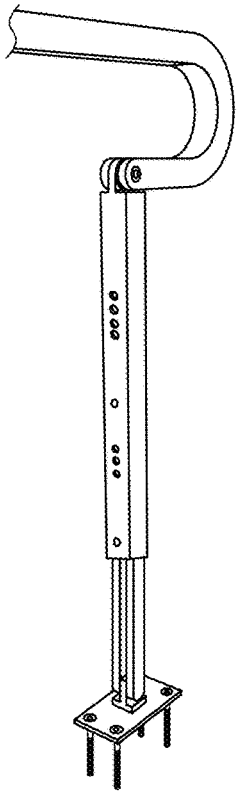
FIG. 25 is a different perspective view of the lower rail of FIG. 23.
Figure 26:
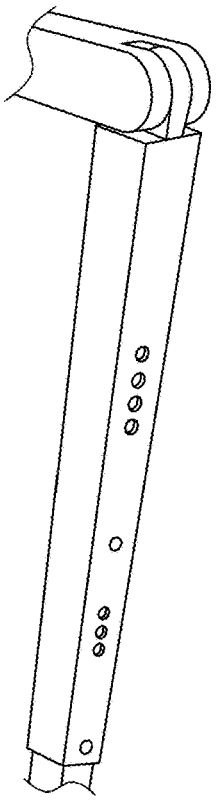
FIG. 26 is a different perspective view of the lower rail of FIG. 23.
Figure 27:
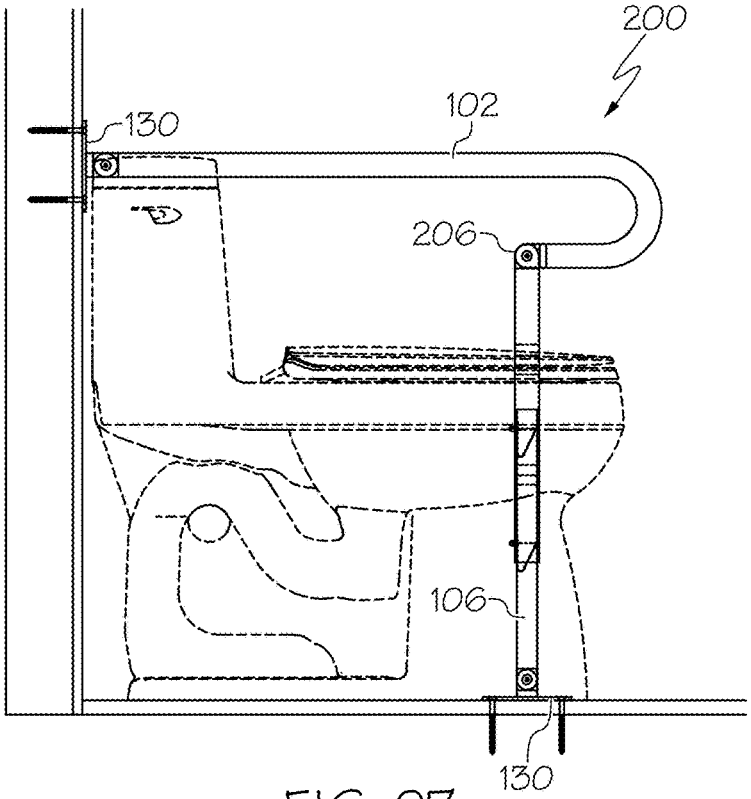
FIG. 27 is a side view of the second configuration of the adjustable grab railing installed next to a toilet.
Figure 40:
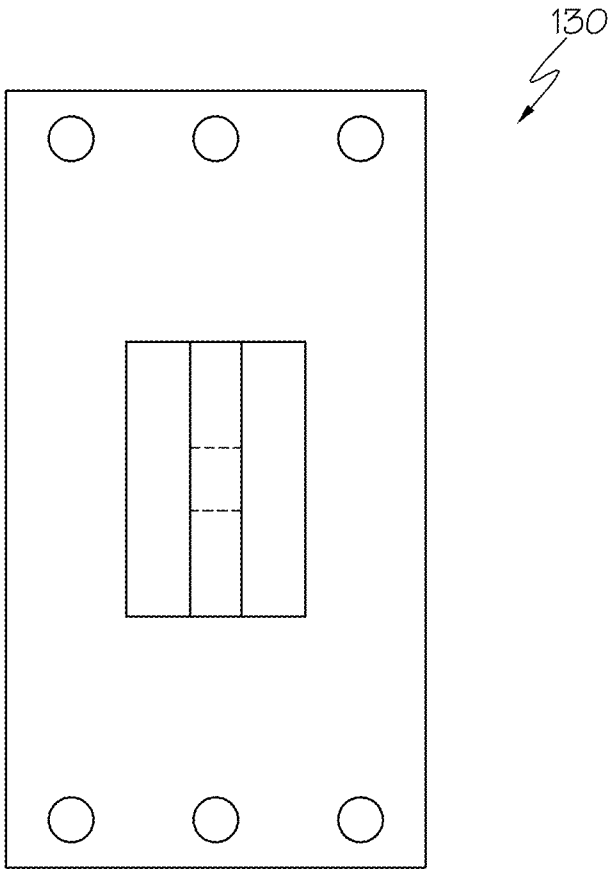
FIG. 40 shows an alternative mounting bracket.
Figure 39:
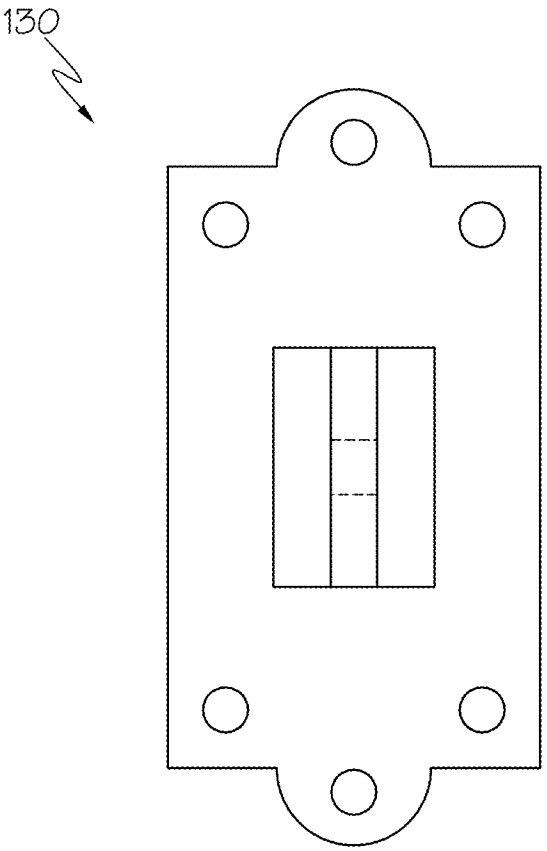
FIG. 39 shows an alternative mounting bracket.

Both mount ends 110 and 118 are configured to be connected to mounting brackets 130 or 132 at a plurality of angles and then locked in place with a first locking fastener. Each rail 102 and 106 is thus selectively pivotably mounted to its own mounting bracket 130 or to its own portion of a common mounting bracket. Brackets 130 are configured to be secured to a flat mounting surface while mounting brackets 132 are configured to be secured over or around a corner such as the corner of a door jamb. Each is secured with fasteners such as screws, bolts, nails, or the like. In the configurations of FIGS. 1-38, four openings are provided in each mounting bracket 130 for use with four fasteners. In the flat configurations of FIGS. 1-10, the four openings are located in the corners and are spaced apart laterally for use with side-by-side door jamb studs. In the corner mounting bracket configuration of FIGS. 11-18, each plate of mounting bracket 132 defines two openings for two fasteners. The heights are offset as shown in FIGS. 13, 14, and 16 so that the fasteners do not interfere with each other when inserted. Alternative configurations of the flat mounting brackets 130 are depicted in FIGS. 39-40 wherein each plate includes a pair of centered fastener openings that are used when mounting bracket 130 is used with a single stud such as when railing 100 is used next to a toilet. The centered fastener openings can be directly between the other fastener openings as shown in FIG. 40 or defined within projections as shown in FIG. 39. Additional alternative mounting brackets are depicted in FIGS. 51-57 and are described below.

Figure 41:
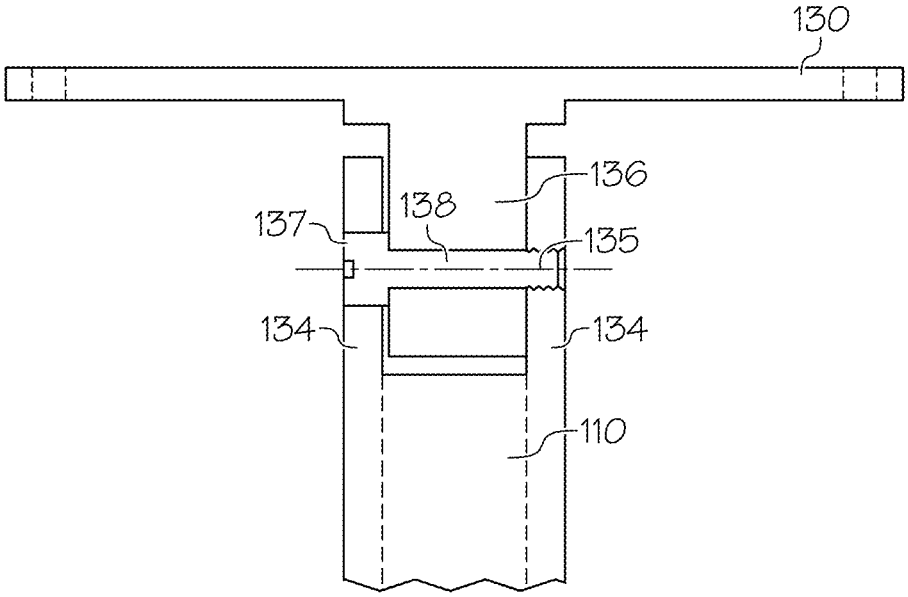
FIG. 41 is a top view of the mounting end locked to the mounting bracket with a first locking configuration.
Figure 42:
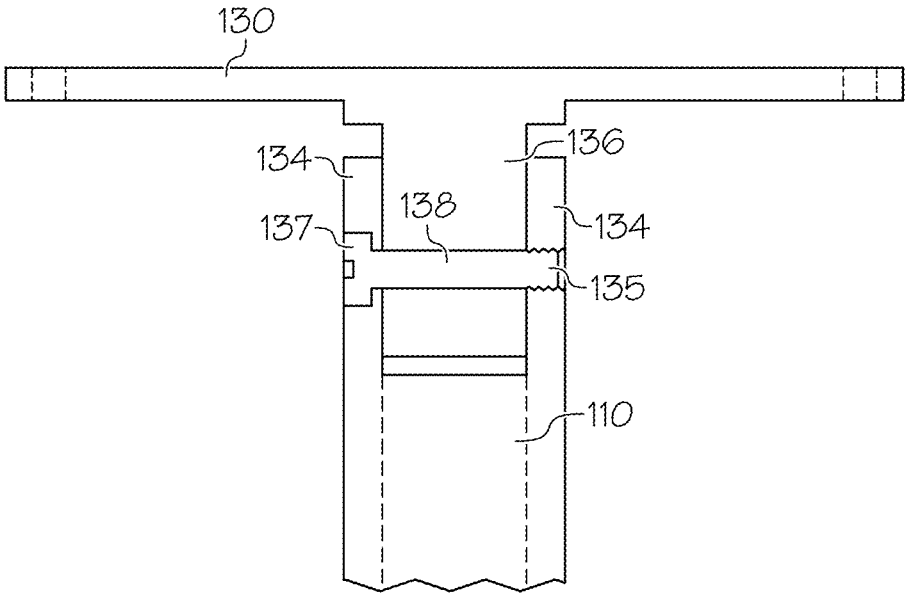
FIG. 42 is a top view of the mounting end locked to the mounting bracket with a second locking configuration.

In the exemplary configuration, each mount end 110 and 118 has two spaced ears 134 that fit over a tab 136 that projects from mounting bracket 130 or 132. In other configurations, ears and tabs can be reversed. Both ears and tab define fastener openings that receives a first locking fastener 138 (see FIGS. 41-42) that is used to lock the selected position between ears and tab. The surfaces that engage each other can be smooth or can be ribbed or textured to increase the grip between the two elements when locked. In the exemplary configurations, first locking fastener 138 is a lock down bolt that threadedly engages one of ears 134 with a threaded end 135 and has a bolt head 137 or shank that either engages tab 136 to press tab 136 against the threaded ear 134 as bolt 138 is tightened or bolt head or shank engages the other ear 134 to clamp ears 134 against tab 136. Optionally, a lock washer is included. When setting the angle between upper rail 102 and bracket 130, the user loosens fastener 138, adjusts the position of upper rail 102, and then tightens fastener 138 to lock the selected position.

Figure 43:
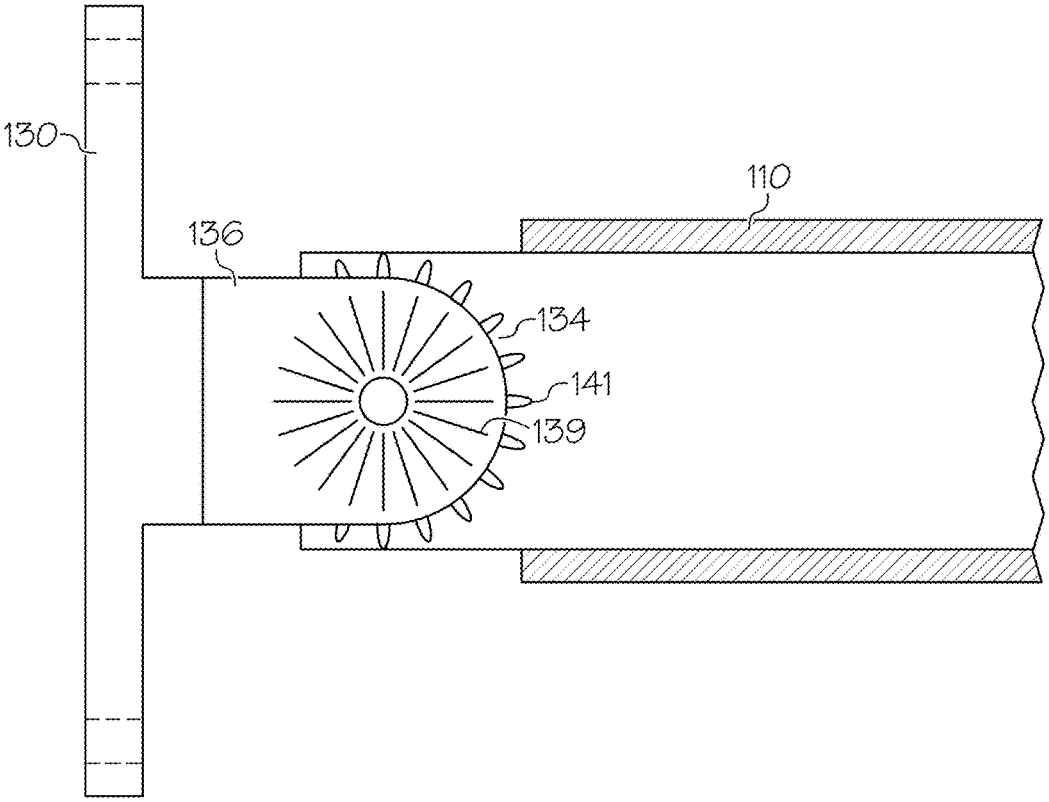
FIG. 43 depicts an alternative configuration for locking the selected angled position of the railing.

In the configuration of FIG. 43, tab 136 defines a plurality of ribs 139 that engage matching grooves 141 defined on the inner surface of ears 134 to lock the positions of the two together when fastener 138 is tightened. Ribs 139 are on rail 102 and grooves 141 are defined by tab 136. These positions may be reversed. In one configuration, ribs 139 and grooves 141 cooperate with an adjustment locking fastener 150 to hold the selected position of railing 100. In another configuration, ribs 139 and grooves 141 are configured to maintain the selected angled position on their own without adjustment locking fastener 150.

Figure 44:
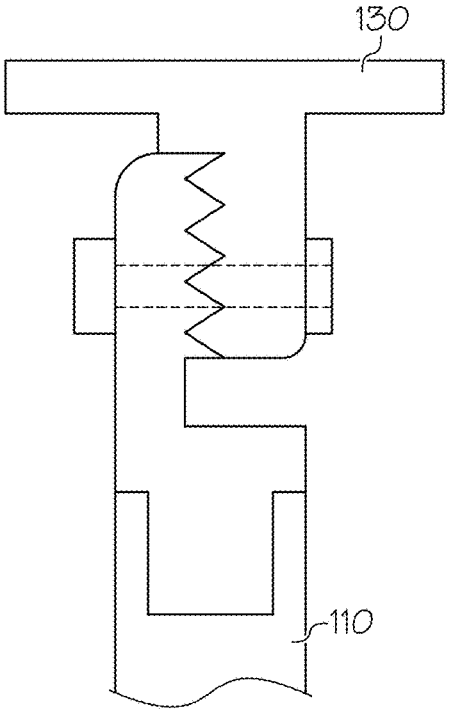
FIG. 44 depicts an alternative configuration for locking the selected angled position of the railing.

Another alternative configuration for railing 100 is shown in FIG. 44. This configuration uses two adjustable locking mounting brackets 130 that have angular adjustments integrated into the locking bracket such that both mounting ends 110 and 118 are locked at the selected angle and adjustment locking fasteners 150 are not needed.

The telescoping arrangement between lower rail 104 and adjustment rail 106 allows the angle of railing 100 and 200 to be adjusted with respect to the mounting structure. As railings 100 and 200 are pivoted with respect to the mounting structure, adjustment end 120 of adjustment rail 106 slides or telescopes with respect to lower rail 104. In one configuration, the angle is selected and then a second locking fastener such as a metal screw, bolt, or pin is inserted through lower rail 104 and adjustment rail 106 to lock the position. In this arrangement, a fastener opening is provided in lower rail 104 and a self-tapping screw is used to engage adjustment rail 106 to lock the two together. In the configurations depicted in the drawings, a second locking fastening system is provided that provides a plurality of preselected angles for railing configurations 100 and 200.

The adjustment locking fastener is either a single fastener 150 or a system that includes a pair of spaced adjustment locking fasteners 150A and 150B depending on the number of preset adjustment angles that are provided. In the exemplary configurations, adjustment locking fastener 150 or system 150 is carried by adjustment rail 106. In the exemplary configurations, adjustment fasteners 150 are quick snap pins (or button pins for telescoping tubing) that are biased toward a locked position by a U-shaped spring such that the locking pin snaps to a locked position when a pin opening defined by lower rail 104 is aligned with the locking pin. The pin openings are defined along the lower surface of the lower rail and when adjustments are provided in small increments, the pin openings would have to overlap to provide the small adjustment. To provide small adjustment increments between angles, two spaced adjustment locking fasteners 150 are used with the adjustment angles alternating between the fasteners.

Figure 31:
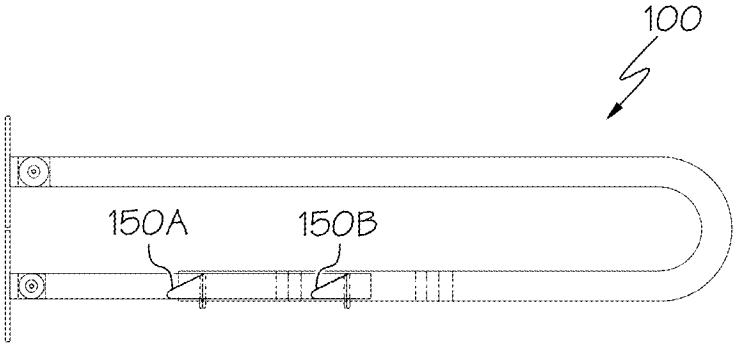
FIG. 31 is a side view of the first configuration of the adjustable grab railing configured at a zero-degree angle for a horizontal application.
Figure 33:
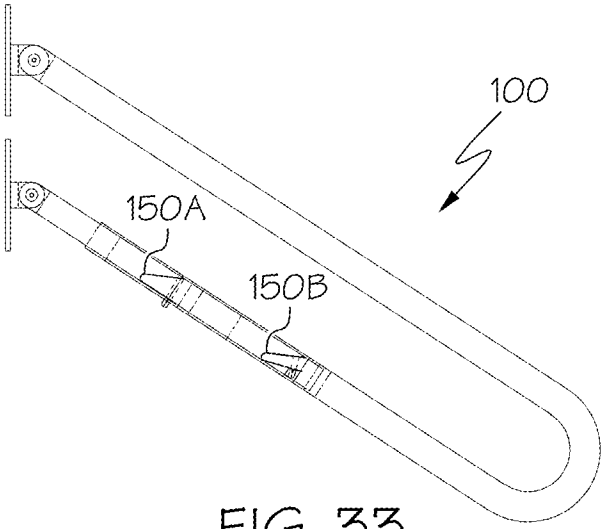
FIG. 33 is a side view of the first configuration of the adjustable grab railing configured at a 33-degree angle.
Figure 36:
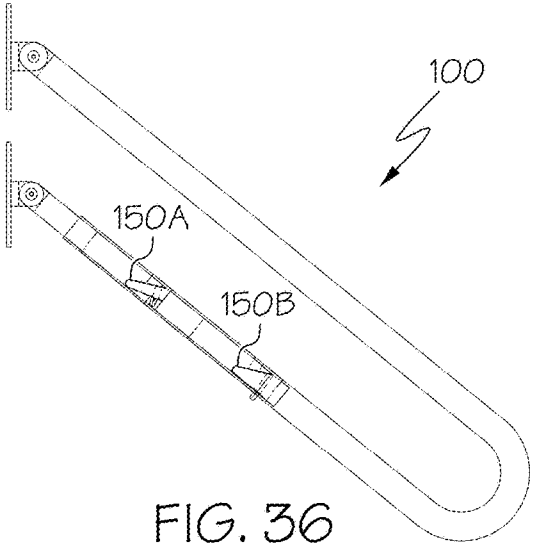
FIG. 36 is a side view of the first configuration of the adjustable grab railing configured at a 39-degree angle.
Figure 38:
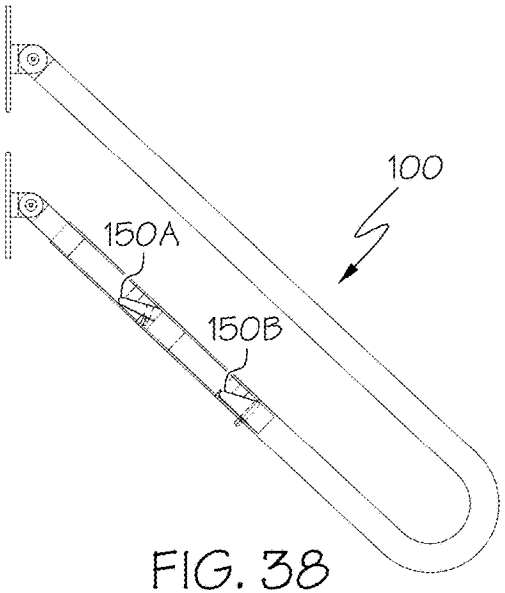
FIG. 38 is a side view of the first configuration of the adjustable grab railing configured at a 43-degree angle.
Figure 35:
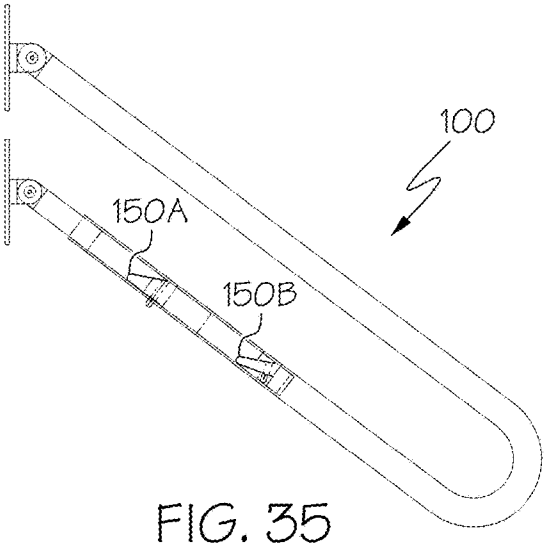
FIG. 35 is a side view of the first configuration of the adjustable grab railing configured at a 37-degree angle.
Figure 37:
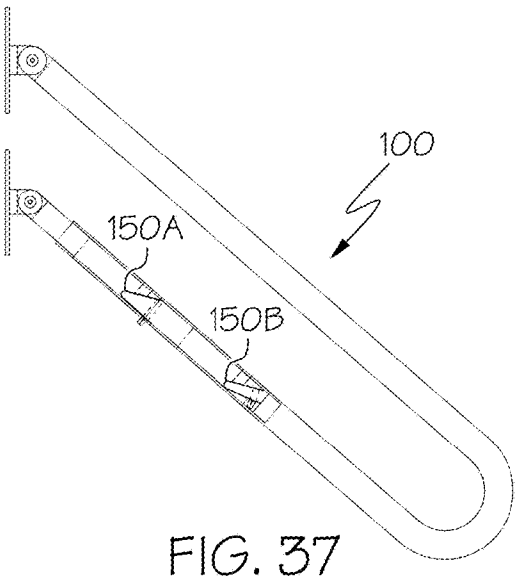
FIG. 37 is a side view of the first configuration of the adjustable grab railing configured at a 41-degree angle.

In the exemplary embodiments, railings 100 and 200 are provided with preset pin openings for a horizontal (zero degree) configuration and seven angled configurations at angles 31, 33, 35, 37, 39, 41, and 43 degrees. These are depicted in FIGS. 31-38 which show which adjustment locking fastener is idle and which is active and locking. In FIG. 31, both adjustment locking fasteners 150 are active and locked. In FIGS. 32, 34, 36, and 38, only the second adjustment locking fastener 150B is active and locked. In FIGS. 33, 35, and 37, the first adjustment locking fastener 150A is active and locked.

Lower rail 104 defines two pin openings 152 that are positioned to receive the locking pins from both adjustment locking fasteners 150 when rails 102 and 104 are horizontal (when mounted to a vertical mounting structure). Lower rail 104 also defines two sets of pin openings 154 and 156 that alternatively align with the locking pins of the first and second adjustment locking fasteners 150 as lower rail slides over alignment rail 106 toward mounting end 118 of alignment rail 106. The second adjustment locking fastener 150B is closer to outer end 116 than the first locking fastener. The 31-degree pin opening is closest to the second adjustment locking fastener 150B so that the locking pin will initially snap into the 31-degree pin opening as lower rail 104 is slid along adjustment rail 106. When a 31-degree adjustment is not desired, the locking pin is pushed back in and lower rail 104 is slid farther along adjustment rail 106 until the locking pin on the first adjustment locking fastener 150A is aligned with the 33-degree pin opening from pin opening set 154. This process can be continued until the locking pin of second adjustment locking fastener 150B snaps into the 43-degree pin opening. Pin opening set 154 has the openings for 33-, 37-, and 41-degree adjustments and pin opening set 156 has the openings for 31-, 35-, 39-, and 43-degree adjustments. Other than when adjusted for horizontal, only one pin is locked in an opening at a time. This configuration allows the two degree increments to be provided while keeping the pin openings on the bottom of lower rail 104. Another configuration locates the first and second adjustment locking fasteners 150 close together but spaced opening sets 154 and 156 are defined about the circumference of lower rail 104. Another configuration provides a single second adjustment locking fastener 150 and a single set of openings (such as 154 or 156) and provide larger angle increments between adjustment positions.

Figure 28:
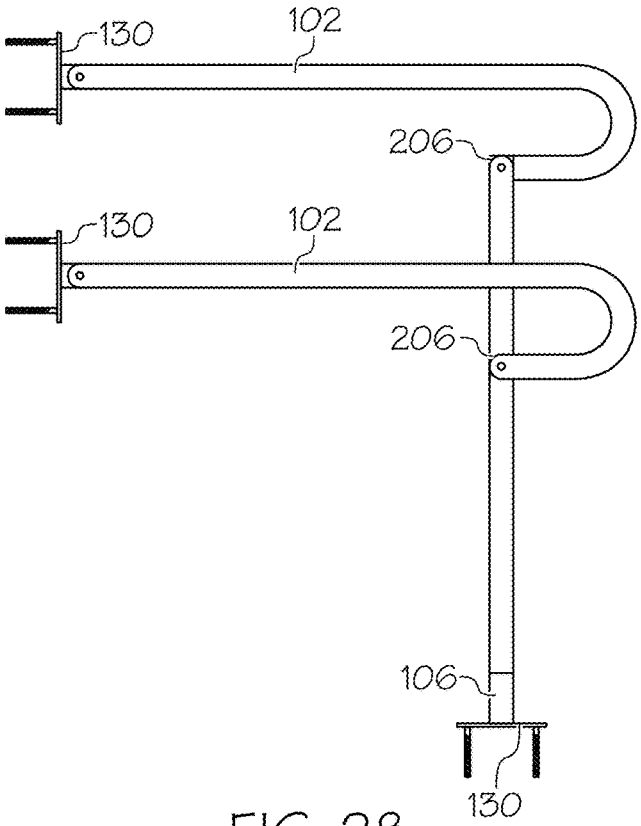
FIG. 28 is a side view of the second configuration of the adjustable grab railing showing the range of adjustable heights.
Figure 30:
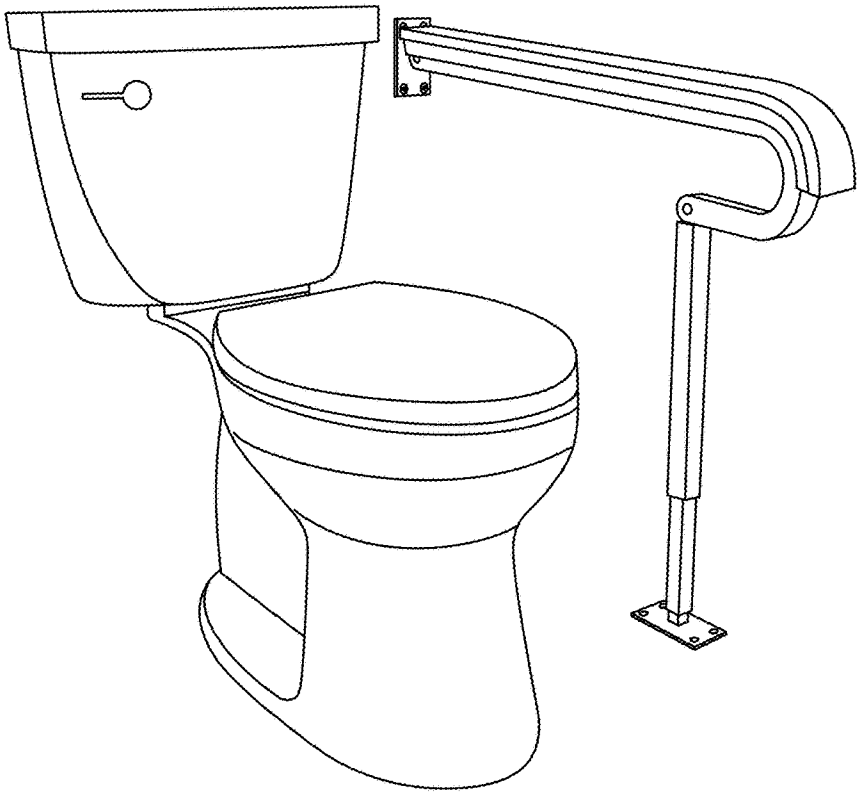
FIG. 30 is a perspective view of the second configuration of the adjustable grab railing installed next to a toilet with an alternative cover for the upper rail.
Figure 29:
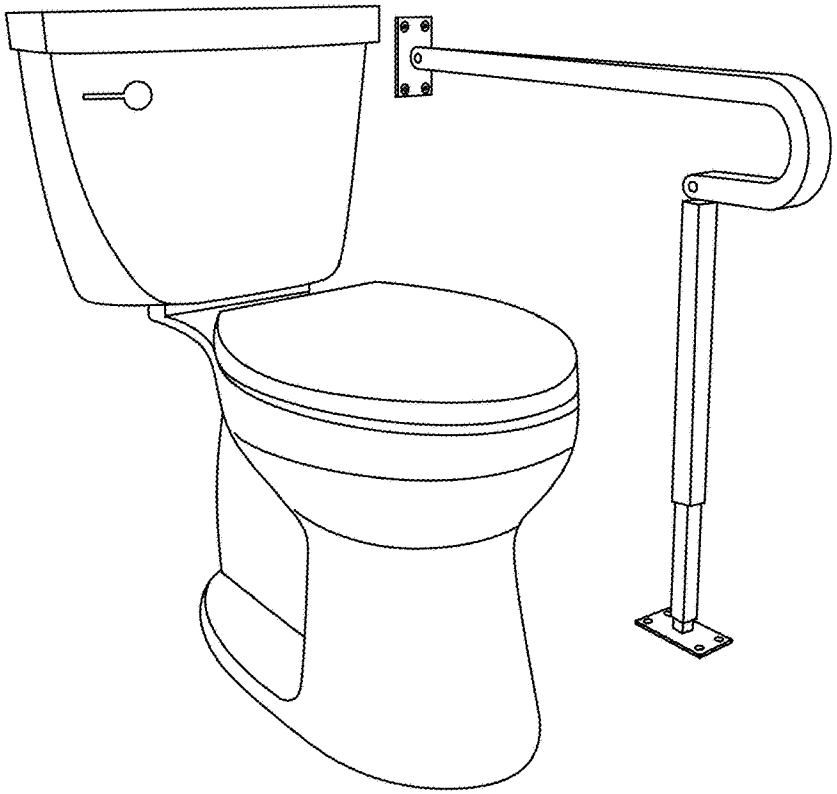
FIG. 29 is a perspective view of the second configuration of the adjustable grab railing installed next to a toilet.
Figure 32:
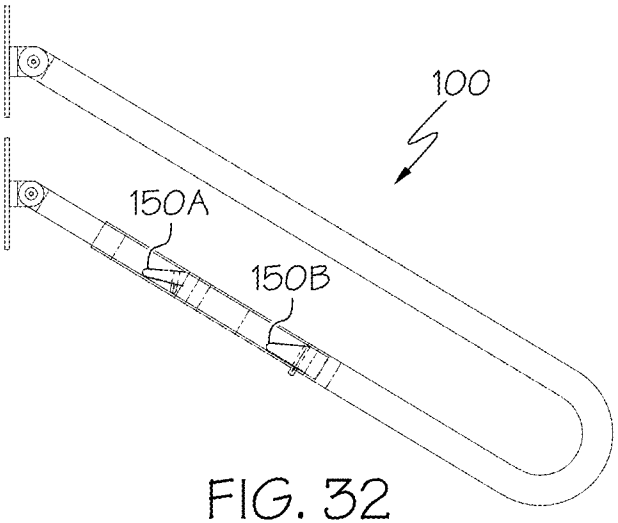
FIG. 32 is a side view of the first configuration of the adjustable grab railing configured at a 31-degree angle.
Figure 34:
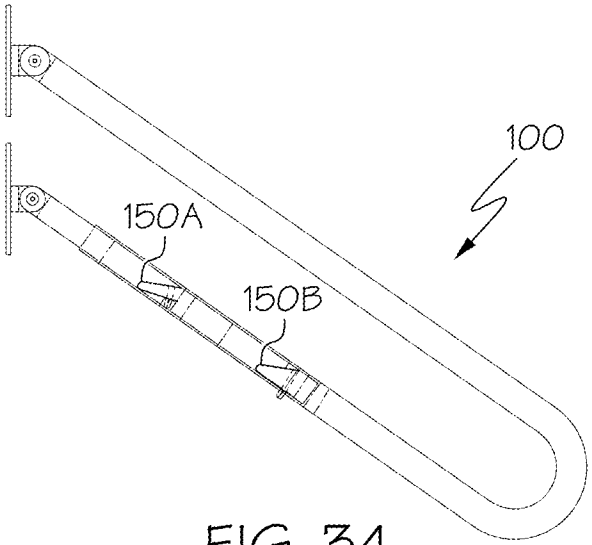
FIG. 34 is a side view of the first configuration of the adjustable grab railing configured at a 35-degree angle.

In the second configuration 200 of adjustable grab railing, lower rail 104 includes a first portion 202 and a second portion 204 connected by a selectively adjustable joint 206. Joint 206 can be the same as ear 134, tab 136, and bolt 138 mounts described above or another locking joint (such as the others described herein) that allows second portion 204 to pivot at least 90 degrees with respect to first portion 202 to provide the configuration of FIGS. 23-30 wherein mount end 118 of adjustment rail 106 is mounted to a horizontal floor and adjustment rail 106 and second portion 204 of lower rail 104 are vertical. In this configuration, the adjustability between adjustment rail 106 and lower rail 104 adjusts the height of upper rail 102 as shown in FIG. 28.

Figure 45:
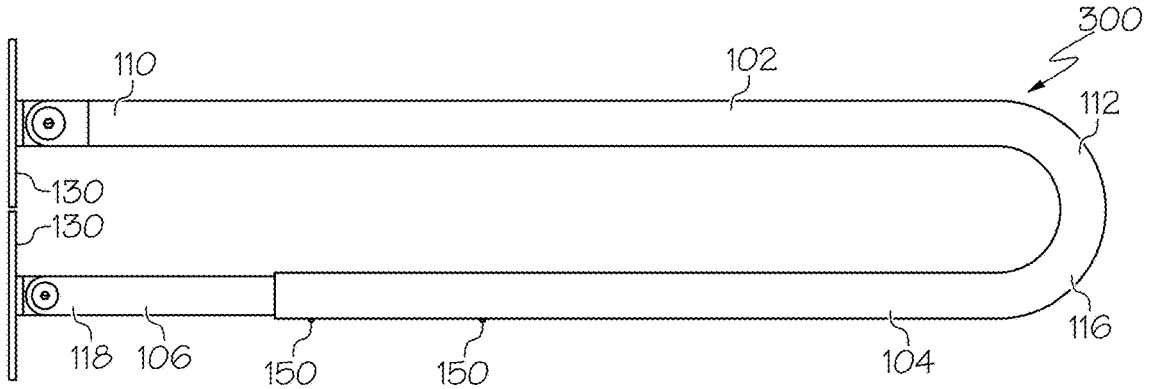
FIG. 45 is a side elevation view of a third configuration of the adjustable grab railing adjusted in a horizontal configuration.
Figure 46:
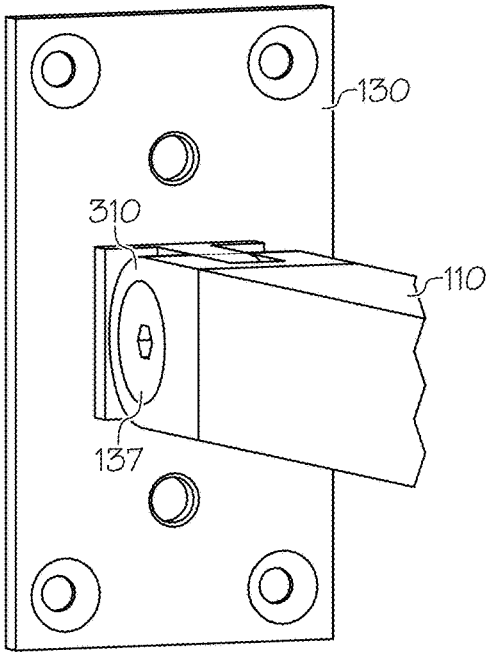
FIG. 46 depicts the connection of the end of the upper railing to a mount bracket.
Figure 47:
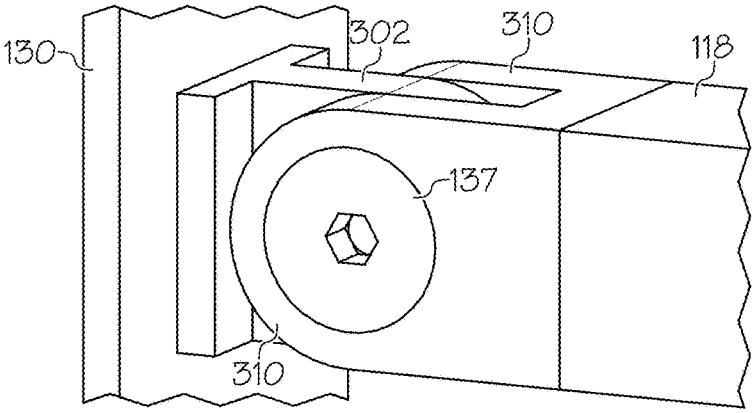
FIG. 47 depicts the connection of the end of the adjustment rail to a mount bracket.
Figure 48:
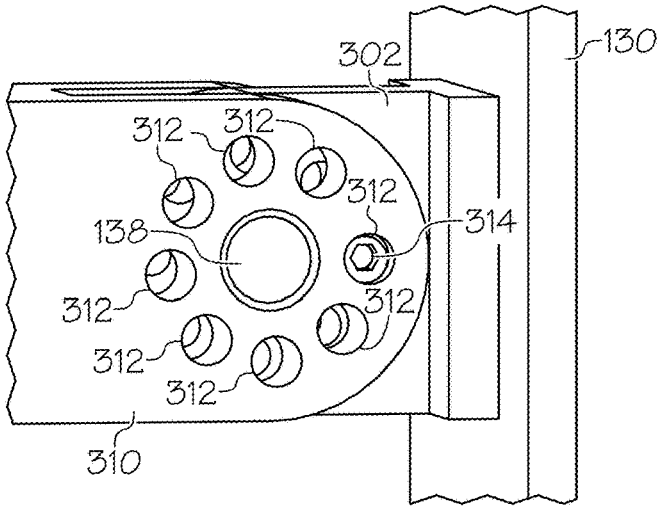
FIG. 48 depicts one of the ears that defines the secondary fastener openings.
Figure 49:
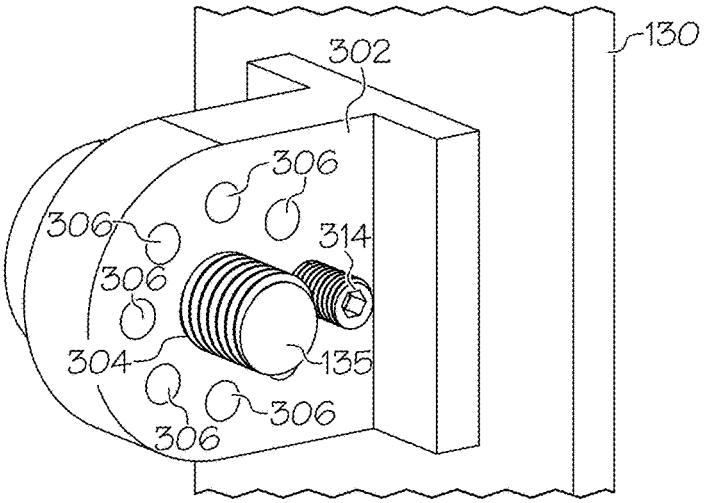
FIG. 49 depicts the mount tab with the primary and secondary fasteners.
Figure 50:
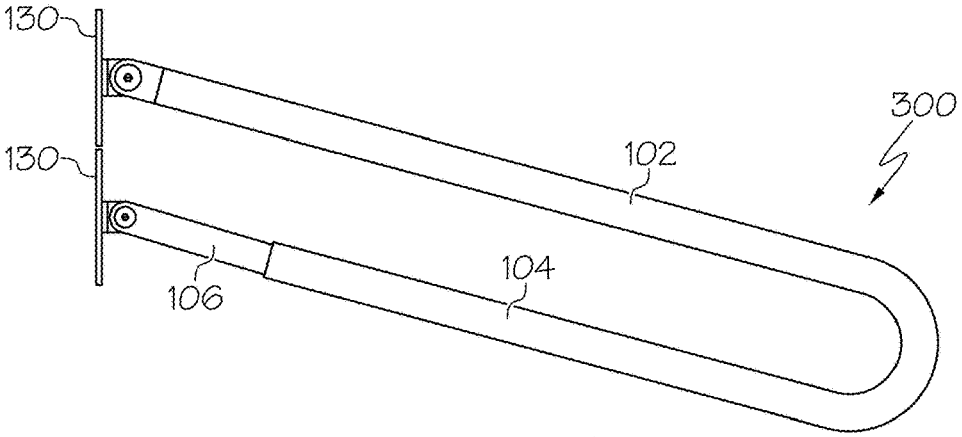
FIG. 50 is a side elevation view of a third configuration of the adjustable grab railing adjusted in an angled configuration.
Figure 51:
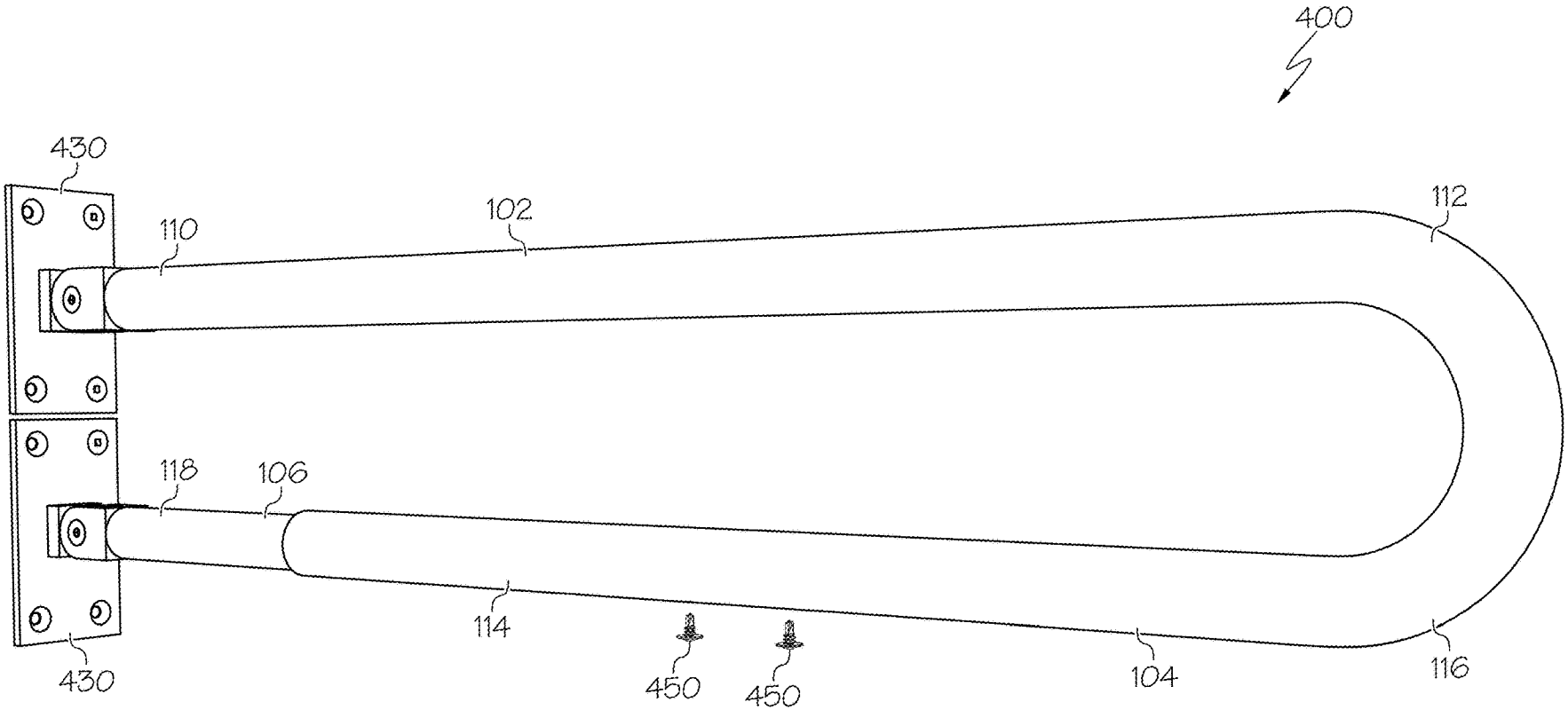
FIG. 51 is a perspective view of a fourth configuration of the adjustable grab railing adjusted in a horizontal configuration.
Figure 52:
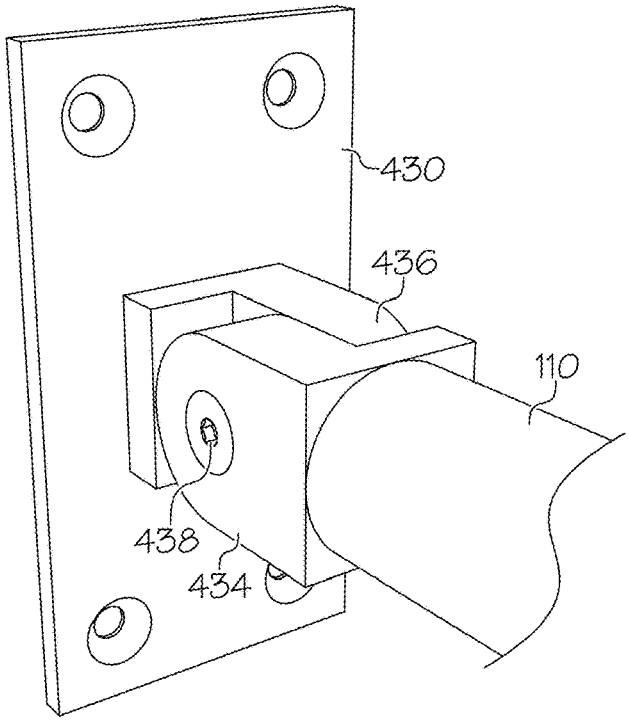
FIG. 52 is an enlarged perspective view of the end of a rail connected to a mounting bracket.
Figure 53:
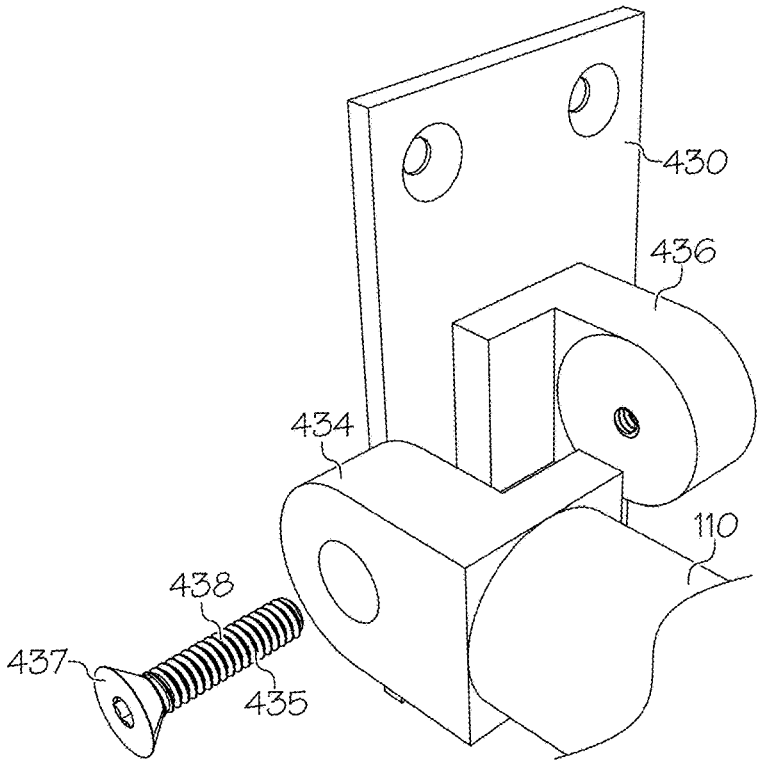
FIG. 53 is an enlarged perspective view showing the end of the rail of FIG. 52 disconnected from the mounting bracket.
Figure 55:
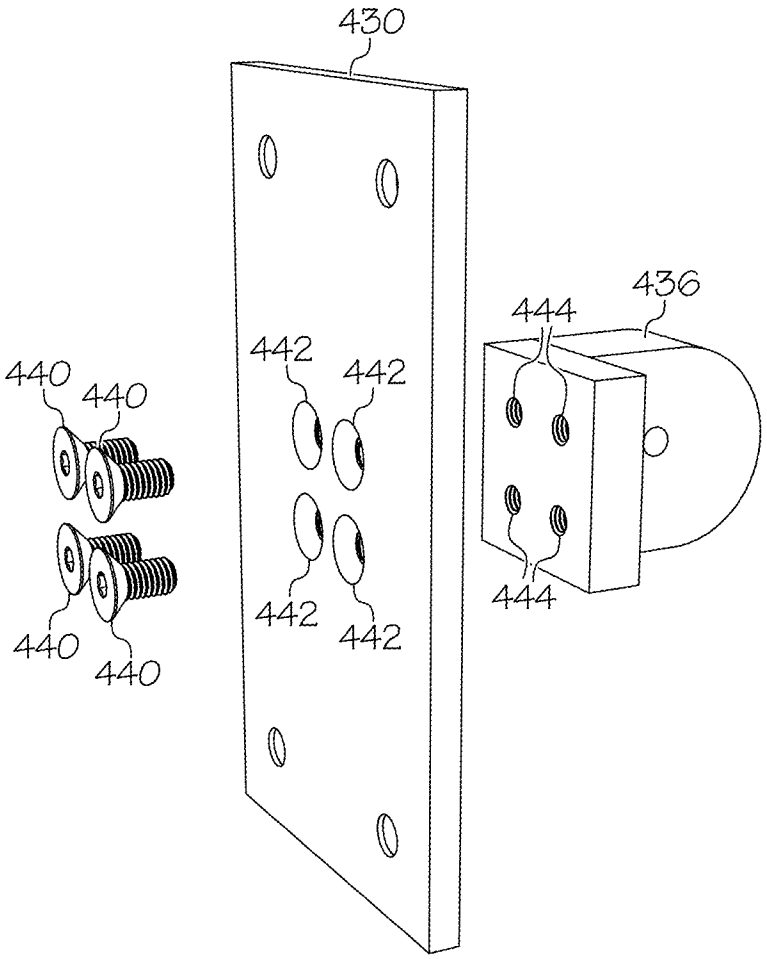
FIG. 55 is an exploded view showing how the mounting bracket is assembled.
Figure 54:
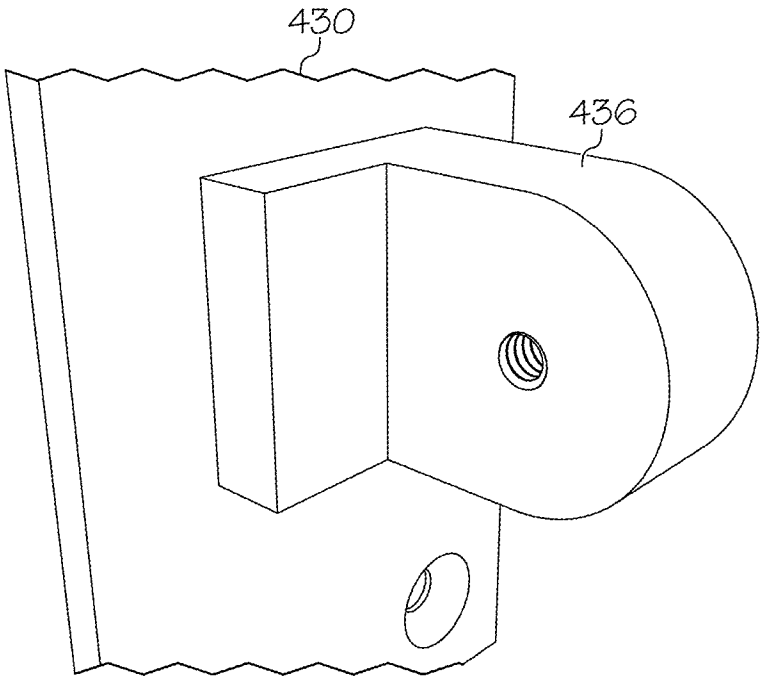
FIG. 54 is a perspective view showing the tab of the mounting bracket.
Figure 57:
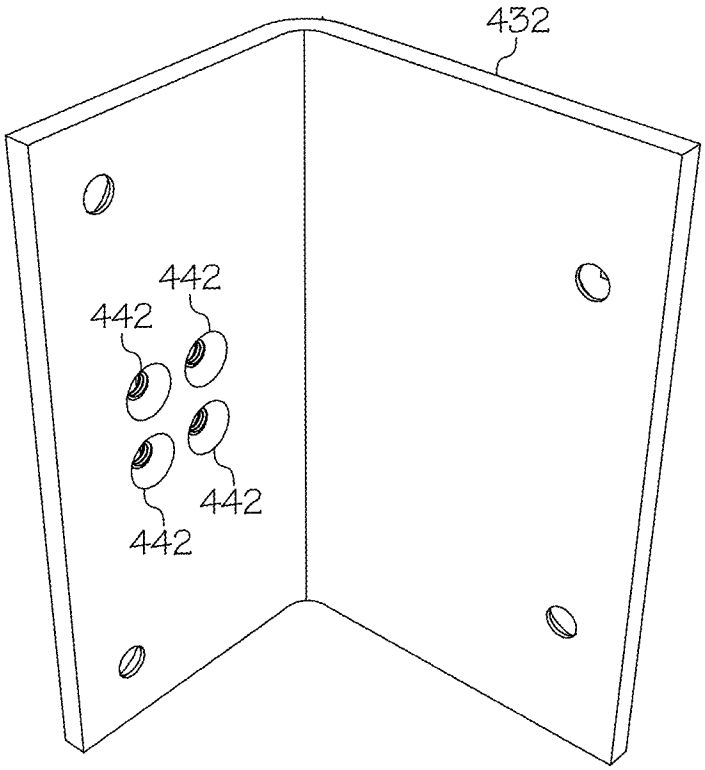
FIG. 57 is a rear perspective view thereof.
Figure 56:
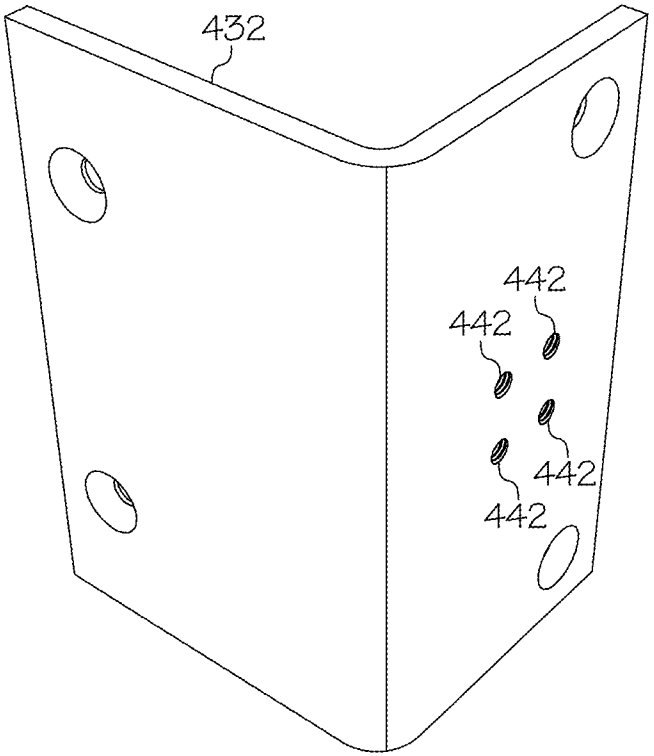
FIG. 56 is a front perspective view of an alternative mounting bracket.

A third configuration of the adjustable grab railing is indicated generally by the reference number 300 in FIGS. 45-50. The third configuration shares elements with the first configuration and the same reference numbers are used in the drawings to identify common elements. In the third configuration, adjustment locking fasteners 150 are optional. FIG. 45 depicts adjustment locking fasteners 150 in a locked configuration with adjustable grab railing 300 adjusted in a horizontal configuration. In FIG. 50, adjustment locking fasteners 150 are not being used. In the third configuration, adjustable grab railing 300 relies on locking fasteners at the mounting plates 130 and mount ends 110 and 118 the to secure the selected position of rails 102 and 104.

As above, each mounting bracket 130 of the third configuration includes a tab 302. In this configuration, tab 302 defines a central fastener opening 304 and a plurality of secondary fastener openings 306. In the exemplary configuration depicted in the drawings, tab 302 defines eight secondary fastener openings 306 which correspond to at least eight adjustment positions for railing 300. Secondary fastener openings 306 can be threaded or not threaded.

Each of upper rail 102 and adjustment rail 106 includes a set of two spaced ears 310 that fit over their respective tabs 302. Each set of spaced ears 310 defines a central fastener opening configured similar to the opening for fastener 138 depicted in FIGS. 41 and 42. In one of the ears 310 of the set, the opening is threaded to threadedly receive threaded end 135 of fastener 138. The other of ears 310 of the set, defines an opening that allows the bolt head 137 to pass through ear 310 and engage tab 302 (the configuration of FIG. 41) or it defines a shoulder (FIG. 42) against which bolt head 137 abuts. These configurations allow one or both ears 310 to be tightened against tab 302 by tightening primary fastener 138.

One of ears 310 in each set of ears also defines a plurality of secondary fastener openings 312 (FIG. 48) surrounding the central fastener opening at a location to match the secondary fastener openings 306 of tab 302. In the exemplary configuration, the secondary fastener openings of the ear and/or the tab are threaded to receive a threaded secondary locking fastener 314.

In the horizontal condition depicted in FIGS. 45-49, secondary locking fastener 314 is positioned in the first secondary fastener opening of both the ears 310 and tab 302. The other secondary fastener openings are positioned such that one set will align when rails 102 and 104 are pivoted down to desired angles. In the exemplary configuration, the openings are arranged to align at rail angles of 31-43 degrees at two degree increments to match the adjustability of the first configuration 100.

Secondary fastener 314 can be threaded to both ear 310 and tab 302 or just one element. In another configuration, both ears 310 can define matching secondary fastener openings with secondary fastener 314 engaging both ears and tab 302. The combination of primary fastener 138 and secondary fastener 314 provides enough holding force to secure the adjusted position of railing 300, but adjustment locking fasteners 150 also can be used as described above.

A fourth configuration of an adjustable grab railing is indicated generally by the number 400 in FIGS. 51-57. The fourth configuration shares elements with the first configuration and the same reference numbers are used in the drawings to identify common elements.

In the example depicted in the drawings, the adjustment end of adjustment rail 106 telescopes inside adjustment end 114 of lower rail 104. At least adjustment end 120 thus has a cross section dimension (width or diameter) that is small enough to allow it to slide inside lower rail 104. In other configurations, the telescoping arrangement is reversed with adjustment end 114 of lower rail 104 located inside the adjustment end of adjustment rail 106.

Lower rail 104 optionally includes adjustable joint 206 as described above that allows adjustment rail 106 to be mounted vertically.

Both mount ends 110 and 118 are configured to be connected to mounting brackets 430 or 432 at a plurality of angles and then locked in place with a first locking fastener 438. Each rail 102 and 106 is thus selectively pivotably mounted to its own mounting bracket 430 (or 432) or to its own portion of a common mounting bracket. Brackets 430 are configured to be secured to a flat mounting surface while mounting brackets 432 are configured to be secured over or around a corner such as the corner of a door jamb. Each is secured with fasteners such as screws, bolts, nails, or the like. In the configurations of FIGS. 51-57, four openings are provided in each mounting bracket 430 for use with four fasteners. In the flat configurations of FIGS. 51-55, the four openings are located in the corners and are spaced apart laterally for use with side-by-side door jamb studs. In the corner mounting bracket configuration of FIGS. 56-57, each plate of mounting bracket 432 defines two openings for two fasteners. The heights are offset as shown in FIGS. 13, 14, 16, 56, and 57 so that the fasteners do not interfere with each other when inserted. Alternative configurations of the flat mounting brackets 430 include a pair of centered fastener openings like those depicted in FIGS. 39-40 that are used when mounting bracket 430 is used with a single stud such as when railing 400 is used next to a toilet.

In the exemplary configuration, each mount end 110 and 118 has one ear 434 that is mounted to a corresponding tab 436 that projects from mounting bracket 430 or 432. In the fourth configuration, tabs 436 are either integral with mounting brackets 430 or 432 or tabs 436 are mounted with mounting fasteners 440 that extend through fastener openings 442 defined by mounting brackets 430 or 432 to engage threaded openings 444 defined by tabs 436. The body of tab 436 covers openings 442 when tab 436 is mounted to hide fasteners 440 from view. Openings 442 are configured to receive the heads of fasteners 440 so that fasteners 440 are flush with the rear surface of bracket 430 or 432.

Both ear 434 and tab 436 define fastener openings that receive first locking fastener 438 (see FIGS. 52-54) that is used to lock the selected position between ear 434 and tab 436. The surfaces that engage each other can be smooth or can be ribbed or textured to increase the grip between the two elements when locked. In the exemplary configuration, first locking fastener 438 is a lock down bolt that at least threadedly engages tab 436 with a threaded end 435 and has a bolt head 437 or shank that engages ear 434 to press ear 434 against tab 436 as fastener 438 is tightened. In another configuration, fastener 438 also can threadedly engage ear 434. Optionally, a lock washer is included. When setting the angle between upper rail 102 and bracket 130, the user loosens fastener 438, adjusts the position of upper rail 102, and then tightens fastener 438 to lock the selected position.

The telescoping arrangement between lower rail 104 and adjustment rail 106 allows the angle of railing 400 to be adjusted with respect to the mounting structure. As railings 102, 104, and 106 are pivoted with respect to the mounting structure, adjustment end 120 of adjustment rail 106 slides or telescopes with respect to lower rail 104. The angle is selected and then one or more adjustment locking fasteners 450 such as a metal screw, bolt, or pin is inserted through portions of lower rail 104 and adjustment rail 106 to lock their positions. In one arrangement, one or more fastener openings are provided in lower rail 104 and self-tapping screws are used to engage adjustment rail 106 to lock the two together. In another configuration, hole sets 154 and 156 are defined as described above to define a plurality of adjustments angles for railing 400. In one embodiment, one or more adjustment fasteners 450 are inserted from the outside of lower rail 104 in one or more holes of hole sets 154 and 156. In another configuration, a single adjustment locking fastener 150 or a plurality of adjustment locking fasteners 150 as described above are used to lock the positions of rails 104 and 106.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Modifications and alterations of those embodiments will be apparent to one who reads and understands this general description. The present disclosure should be construed as including all such modifications and alterations insofar as they come within the scope of the appended claims or equivalents thereof. Throughout the description and claims of this specification the words "comprise" and "include" as well as variations of those words, such as "comprises," "includes," "comprising," and "including" are not intended to exclude additives, components, integers, or steps.

The invention claimed is:

1. An adjustable grab railing comprising:

an upper rail having an inner mount end and an outer end; the upper rail having a straight portion;

the inner mount end of the upper rail being selectively pivotably connected to an upper mounting bracket portion to selectively pivot in a vertical reference plane;

an adjustment rail having an inner mount end and an adjustment end;

the inner mount end of the adjustment rail being selectively pivotably connected to a lower mounting bracket portion to selectively pivot in the vertical reference plane through a plurality of positions;

the upper mounting bracket portion being positioned vertically above the lower mounting bracket portion;

a lower rail having an inner adjustment end and an outer end; the lower rail having a straight portion;

the upper rail being spaced vertically above the adjustment rail and lower rail with the straight portion of the upper rail being parallel to the straight portion of the lower rail;

the adjustment end of the adjustment rail and the inner adjustment end of the lower rail sliding with respect to each other when the upper rail and adjustment rail are pivoted in the vertical reference plane such that the angles of the upper rail, the adjustment rail, and the lower rail can be adjusted at the same time with respect to the mounting bracket portions; and an adjustment locking fastener that selectively locks the position of the adjustment rail with respect to the lower rail.

2. The adjustable grab railing of claim 1, wherein the outer end of the upper rail is connected to the outer end of the lower rail.

3. The adjustable grab railing of claim 2, wherein the outer end of the upper rail is integrally connected to the outer end of the lower rail.

4. The adjustable grab railing of claim 3, wherein the combined outer ends of the upper and lower rails define a 180-degree curve.

5. The adjustable grab railing of claim 1, wherein the adjustment end of the adjustment rail is located inside the inner adjustment end of the lower rail.

6. The adjustable grab railing of claim 5, wherein the adjustment locking fastener is carried inside the adjustment rail.

7. The adjustable grab railing of claim 6, wherein the adjustment locking fastener includes spaced first and second adjustment locking fasteners.

8. The adjustable grab railing of claim 7, wherein the lower rail defines a first set of spaced openings aligned with the first adjustment locking fastener and the lower rail defines a second set of spaced openings aligned with the second adjustment locking fastener.

9. The adjustable railing of claim 1, wherein the lower rail has first and second portions joined by an adjustable joint that allows the second portion to selectively pivot with respect to the first portion so that the second portion can be arranged vertically.

10. The adjustable railing of claim 1, further comprising an upper ear connected to the inner mount end of the upper rail and a lower ear connected to the inner mount end of the adjustment rail; the upper ear being connected to an upper mount tab that extends from the upper mounting bracket portion; and the lower ear being connected to a lower mount tab that extends from the lower mounting bracket portion.

11. The adjustable railing of claim 10, further comprising an upper locking fastener that threadedly engages one of the upper ear and the upper mount tab.

12. The adjustable railing of claim 11, wherein the upper locking fastener includes a portion that engages the other of the upper ear and the upper mount tab such that the upper ear and upper mount tab are forced together when the upper locking fastener is tightened.

13. The adjustable railing of claim 10, further comprising a lower locking fastener that threadedly engages one of the lower ear and the lower mount tab.

14. The adjustable railing of claim 13, wherein the lower locking fastener includes a portion that engages the other of the lower ear and the lower mount tab such that the lower ear and lower mount tab are forced together when the lower locking fastener is tightened.

15. The adjustable railing of claim 10, wherein each ear has a first contact surface and each mount tab has a second contact surface; the first contact surface being in direct contact with the second contact surface when an ear is connected to and locked to a mount tab.

16. The adjustable railing of claim 15, wherein at least a portion of at least one of the first and second contact surfaces is textured.

17. The adjustable railing of claim 15, wherein at least a portion of at least one of the first and second contact surfaces is ribbed.

18. An adjustable grab railing comprising:

an upper rail having an inner mount end and an outer end;

the inner mount end of the upper rail being selectively pivotably connected to an upper mounting bracket portion;

an adjustment rail having an inner mount end and an adjustment end;

the inner mount end of the adjustment rail being selectively pivotably connected to a lower mounting bracket portion;

a lower rail having an inner adjustment end and an outer end;

the adjustment end of the adjustment rail and the inner adjustment end of the lower rail selectively telescoping with respect to each other;

an adjustment locking fastener that selectively locks the position of the adjustment rail with respect to the lower rail;

wherein the upper rail has a straight portion between its inner mount end and its outer end; the lower rail having a straight portion between its adjustment end and its outer end; the straight portions of the upper and lower rails being parallel;

wherein the adjustment end of the adjustment rail is located inside the inner adjustment end of the lower rail;

wherein the adjustment locking fastener is carried inside the adjustment rail;

wherein the adjustment locking fastener includes spaced first and second adjustment locking fasteners;

wherein the lower rail defines a first set of spaced openings aligned with the first adjustment locking fastener and the lower rail defines a second set of spaced openings aligned with the second adjustment locking fastener; and wherein the first and second sets of spaced openings provide seven angled configurations for the upper and lower rails from 31-degrees to 43-degrees in 2-degree increments; each of the seven angled configurations being relative to a horizontal reference line.

19. The adjustable grab railing of claim 18, wherein the lower rail also defines at least one fastener opening that is engaged by the adjustment locking fastener when the upper and lower rails are positioned to be horizontal.

20. An adjustable grab railing for use with steps having a pitch wherein the adjustable grab railing is mounted to a jamb structure at the top of at least one of the steps; the adjustable grab railing comprising:

an upper rail having an inner mount end and an outer end;

the inner mount end of the upper rail being selectively pivotably connected to an upper mounting bracket portion capable of being mounted to the jamb structure;

an adjustment rail having an inner mount end and an adjustment end; the adjustment rail being parallel to the upper rail;

the inner mount end of the adjustment rail being selectively pivotably connected to a lower mounting bracket portion capable of being mounted to the jamb structure;

the upper mounting bracket portion being positioned vertically above the lower mounting bracket portion;

a lower rail having an inner adjustment end and an outer end;

the upper rail being spaced vertically above the lower rail such that both the upper rail and lower rail can be used as a grab rail next to the steps;

the adjustment end of the adjustment rail and the inner adjustment end of the lower rail sliding with respect to each other when the upper rail and adjustment rail are pivoted with respect to the mounting bracket portions such that the angles of the upper rail, the adjustment rail, and the lower rail can be adjusted together to match the pitch of the steps by pivoting all with respect to the mounting bracket portions; and an adjustment locking fastener that selectively locks the position of the adjustment rail with respect to the lower rail.

* * * * *